US010415274B2

(12) United States Patent
Nagata et al.

(10) Patent No.: US 10,415,274 B2
(45) Date of Patent: Sep. 17, 2019

(54) VEHICLE HANDLE DEVICE

(71) Applicant: AISIN SEIKI KABUSHIKI KAISHA, Kariya-shi, Aichi-ken (JP)

(72) Inventors: Koichi Nagata, Chiryu (JP); Nobukazu Araki, Hekinan (JP); Jun Hasegawa, Nagoya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 308 days.

(21) Appl. No.: 15/365,149

(22) Filed: Nov. 30, 2016

(65) Prior Publication Data

US 2017/0152683 A1 Jun. 1, 2017

(30) Foreign Application Priority Data

Nov. 30, 2015 (JP) ..... 2015-233231

(51) Int. Cl.
*E05B 77/06* (2014.01)
*E05B 79/06* (2014.01)
(Continued)

(52) U.S. Cl.
CPC ..... *E05B 77/06* (2013.01); *E05B 79/06* (2013.01); *E05B 79/08* (2013.01); *E05B 85/14* (2013.01);
(Continued)

(58) Field of Classification Search
CPC ..... E05B 77/06; E05B 79/06; E05B 79/08; E05B 85/14; E05B 2015/041; E05B 2015/0437
(Continued)

(56) References Cited

U.S. PATENT DOCUMENTS

2005/0206176 A1* 9/2005 Ooe ..... E05B 77/06 292/336.3
2006/0163887 A1* 7/2006 Savant ..... E05B 77/06 292/336.3
(Continued)

FOREIGN PATENT DOCUMENTS

JP 2008-156935 A 7/2008

OTHER PUBLICATIONS

The extended European Search Report dated Mar. 27, 2017, by the European Patent Office in corresponding European Patent Application No. 16201458.3-1609. (10 pgs).

*Primary Examiner* — Nathan Cumar
(74) *Attorney, Agent, or Firm* — Buchanan, Ingersoll & Rooney PC

(57) ABSTRACT

A vehicle handle device includes: a handle support member; a handle rotatably supported by the handle support member and causing a locking device to perform a transition from a latched state to an unlatched state; a rotary member rotatable around a rotary shaft with respect to the handle support member; and a torsion coil spring having a main body portion extending to have a spiral shape and disposed on the periphery of the rotary shaft, and first and second engagement pieces extending from both ends of the main body portion, respectively, and generating a bias force causing the rotary member to rotate around the rotary shaft when the first and second engagement pieces engage with the rotary member and the handle support member, respectively, in a state where the main body portion is elastically deformed.

3 Claims, 18 Drawing Sheets

(51) Int. Cl.
*E05B 79/08* (2014.01)
*E05B 85/14* (2014.01)
*E05B 15/04* (2006.01)

(52) U.S. Cl.
CPC . *E05B 2015/041* (2013.01); *E05B 2015/0437* (2013.01)

(58) Field of Classification Search
USPC ..... 292/336.3
See application file for complete search history.

(56) References Cited

U.S. PATENT DOCUMENTS

2010/0175220 A1* 7/2010 Kajio ..... B60N 3/023
16/110.1
2013/0106121 A1* 5/2013 Hasegawa ..... E05C 3/14
292/220
2017/0096843 A1* 4/2017 Seo ..... B60J 5/0493

* cited by examiner

VEHICLE HANDLE DEVICE

CROSS REFERENCE TO RELATED APPLICATIONS

This application is based on and claims priority under 35 U.S.C. § 119 to Japanese Patent Application 2015-233231, filed on Nov. 30, 2015, the entire contents of which are incorporated herein by reference.

TECHNICAL FIELD

This disclosure relates to a vehicle handle device.

BACKGROUND DISCUSSION

FIGS. 21 and 22 illustrate an example of a handle device that is fixed to an outer panel which configures a vehicle-exterior-side surface of a vehicle door that can be opened or closed with respect to a vehicle body. Note that, an example of this type of handle device in the related art includes a handle device disclosed in JP 2008-156935A (Reference 1).

The handle device includes a handle support member as a base member and an outside handle (not illustrated) that is positioned on a vehicle exterior side of the handle support member and is rotatably supported by the handle support member. The outside handle is able to rotate with respect to the handle support member between an initial position and an operational position.

The handle support member is provided with a linkage mechanism not illustrated. A part of the linkage mechanism is linked to the outside handle. Further, another part of the linkage mechanism is connected to one end of a metal rod (not illustrated). The other end of the rod is linked to a locking device provided in the vehicle door.

When the outside handle rotates from the initial position to the operational position, the linkage mechanism operates. Then, a rotating force from the outside handle is transmitted to the rod via the linkage mechanism and the rod is shifted. Then, the locking device connected to the other end of the rod enters a switching mode from a latched state to an unlatched state. As a result, the vehicle door can be opened or closed with respect to the vehicle body.

For example, when a vehicle, in which the handle device is mounted, collides with another vehicle, the inertia acts on the vehicle due to the collision. When a direction of the inertia acting on the handle device is (substantially) coincident with a moving direction of the outside handle from the initial position to the operational position, there is a concern that the outside handle will move to the operational position due to the inertia and the locking device will unexpectedly enter the switching mode from the latched state to the unlatched state.

In order to cope with the above problem, the handle support member is provided with a rotatable inertia lever that is illustrated in the figures.

As illustrated in the figures, the inertia lever integrally includes a lever main body, a rotary shaft fixed to the central portion of the lever main body, and a counterweight that is fixed to one end portion of the lever main body and is made of a material having a higher specific gravity than the lever main body.

The inertia lever is rotatable with respect to the handle support member between a non-regulation position at which the operation of the linkage mechanism is not interrupted and a regulation position at which the operation of the linkage mechanism is interrupted.

Further, a torsion coil spring is provided between the inertia lever and the handle support member. The torsion coil spring causes the inertia lever to rotate and be biased to the non-regulation position.

In normal times (when no collision or the like occurs to the vehicle in which the handle device is mounted), since the torsion coil spring causes the inertia lever to be positioned at the non-regulation position, the inertia lever does not interrupt the operation of the linkage mechanism. Hence, when an occupant in the vehicle rotates the outside handle from the initial position to the operational position, the linkage mechanism operates through interlocking with the rotation, and, as a result, the locking device enters a switching mode from the latched state to the unlatched state.

On the other hand, when the inertia acts on the handle device (substantially) in the same direction as the moving direction of the outside handle from the initial position to the operational position due to the collision of the vehicle, the inertia lever swiftly moves from the non-regulation position to the regulation position due to the inertial. In other words, before the outside handle moves from the initial position to the operational position due to the inertia, the inertia lever moves from the non-regulation position to the regulation position.

Therefore, the operation of the linkage mechanism, which is interlocked with the movement of the outside handle to the operational position, is regulated by the inertia lever positioned at the regulation position.

Hence, it is possible to decrease a concern that the locking device will unexpectedly enter the switching mode from the latched state to the unlatched state.

In the handle device, the inertia lever and the torsion coil spring are attached to the handle support member through the following procedure.

First, as illustrated in FIGS. 21 and 22, the torsion coil spring is installed on the inertia lever separated from the handle support member (refer to FIG. 23).

The torsion coil spring has a cylindrical main body portion extending to have a spiral shape and a first engagement piece and a second engagement piece which extend from both ends of the main body portion, respectively.

As illustrated in FIGS. 21 and 22, the rotary shaft of the inertia lever is inserted into the main body portion, and thereby the torsion coil spring is attached to the inertia lever.

As illustrated in the figures, the inertia lever is provided with a lever-side engagement portion that can engage with the first engagement piece of the torsion coil spring. However, the inertia lever is not provided with a portion that can engage with the second engagement piece of the torsion coil spring.

Therefore, the torsion coil spring (main body portion) installed on the inertia lever is able to rotate with respect to the rotary shaft.

Subsequently, while an operator grips the inertia lever and the torsion coil spring in a hand, the operator engages the first engagement piece with the lever-side engagement portion.

Further, the second engagement piece griped in the hand is engaged with a support-member-side engagement portion formed in the handle support member and the second engagement piece is sufficiently bent due to a reaction force received from the support-member-side engagement portion.

While the second engagement piece is held in the bending state, both end portions of the rotary shaft of the inertia lever are caused to move to a position at which both of the end portions can be fitted into a pair of recessed support portions (not illustrated) formed in an inner surface of a wall of the handle support member.

As illustrated in FIG. 23, while the second engagement piece and the support-member-side engagement portion are held in the engaging state, both of the end portions of the rotary shaft of the inertia lever are caused to be fitted into the pair of recessed support portions of the handle support member.

In this manner, when the inertia lever is installed in the handle support member, the inertia lever is able to rotate around the rotary shaft with respect to the handle support member. Further, the main body portion of the torsion coil spring is elastically deformed and the torsion coil spring causes the inertia lever to rotate and be biased to the non-regulation position side.

In the handle device described above, when the inertia lever is separated from the handle support member (before being attached), rotation of the torsion coil spring with respect to the inertia lever is not regulated.

Therefore, as described above, in order to install the inertia lever in the handle support member, there is a need to fit both of the end portions of the rotary shaft of the inertia lever into the pair of recessed support portions of the handle support member while the operator engages the second engagement piece with the support-member-side engagement portion by hand. However, this is no easy work.

Note that, if the inertia lever and the torsion coil spring are caused to be attached to the handle support member with the second engagement piece not gripped by hand, the torsion coil spring is likely to relatively rotate with respect to the inertia lever during the attachment work. Therefore, there is a concern that the second engagement piece will hook on a portion of the handle support member other than the support-member-side engagement portion and, as a result, both of the end portions of the rotary shaft of the inertia lever are not able to be fitted into the pair of recessed support portions of the handle support member.

SUMMARY

Thus, a need exists for a vehicle handle device which is not suspectable to the drawback mentioned above.

A vehicle handle device according to an aspect of this disclosure includes: a handle support member fixed to a vehicle door; a handle that is rotatably supported by the handle support member and causes, through rotating thereof, a locking device provided in the vehicle door to perform a transition from a latched state to an unlatched state; a rotary member that is installed to be rotatable around a predetermined rotary shaft with respect to the handle support member; and a torsion coil spring that has a main body portion which extends to have a spiral shape and is disposed on the periphery of the rotary shaft, and a first engagement piece and a second engagement piece which extend from both ends of the main body portion, respectively, and that generates a bias force that causes the rotary member to rotate around the rotary shaft when the first engagement piece and the second engagement piece engage with the rotary member and the handle support member, respectively, in a state in which the main body portion is elastically deformed. The rotary member includes a first engagement portion that engages with the first engagement piece, and a second engagement portion with or from which the second engagement piece is able to engage or to be separated in the state in which the main body portion is elastically deformed.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, a first embodiment disclosed here will be described with reference to FIGS. 1 to 14. Note that a direction in the following description means a direction of an arrow in the figures.

Figure 1:
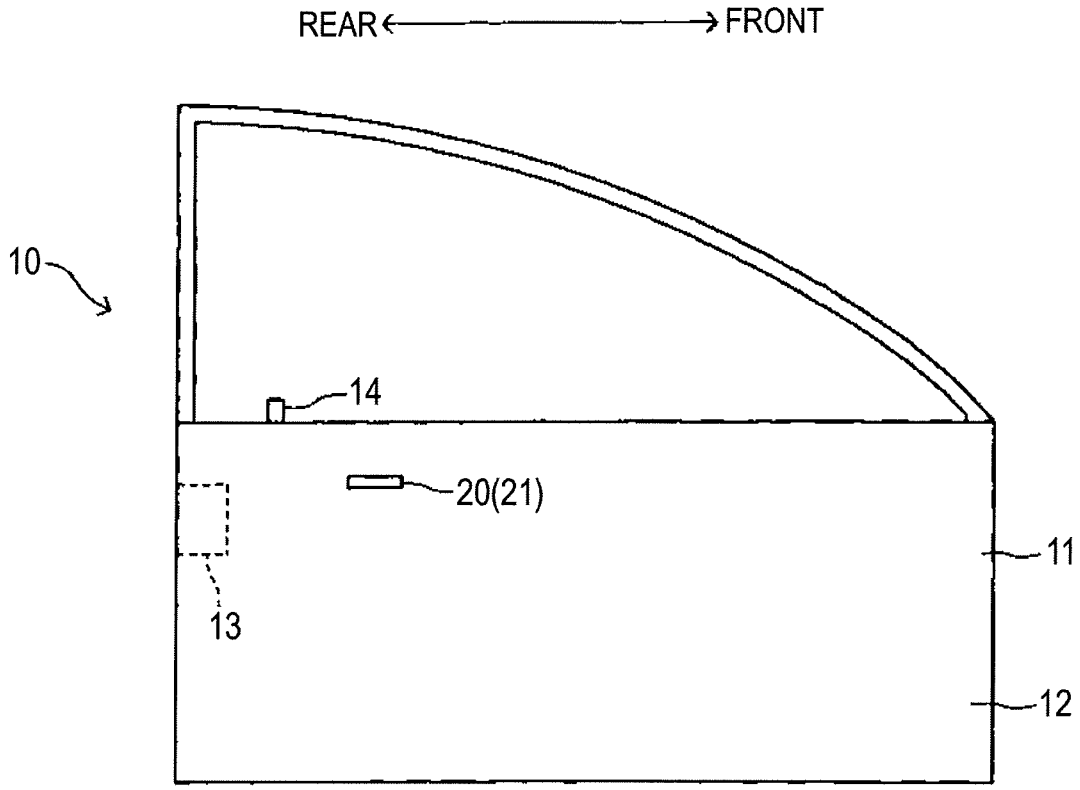
FIG. 1 is a side view of a vehicle door of a first embodiment disclosed here, when viewed from a vehicle exterior side.

A vehicle door 10 illustrated in FIG. 1 is supported to be rotatable around a rotary shaft in a vertical direction with respect to a vehicle body (not illustrated) and is able to open and close an opening formed on a side of the vehicle body. The vehicle door 10 of the embodiment is a side door on the right side.

A lower half part of the vehicle door 10 is configured of a vehicle-exterior-side surface of a door main body 11, and the vehicle-exterior-side surface is configured of an outer panel 12 which is formed of a metal plate.

A locking device 13 is provided inside the vehicle door 10, and a part of the locking device is exposed through a rear end surface of the vehicle door 10. The locking device 13 has a known structure that includes a latch or a pole. The locking device 13 is linked to a locking knob 14 that is provided on an upper end surface of a trim (not illustrated) which configures a vehicle-interior-side surface of the vehicle door 10 so as to be slidable in the vertical direction. Further, the locking device 13 is linked to a handle device 20 that includes an outside handle 21 that is rotatably supported by the outer panel 12.

As known in the related art, when the locking knob 14 is positioned at a locking position (not illustrated) in a case where the vehicle door 10 closes the opening of the vehicle body, the locking device 13 is in a latched state in which a latch grips a striker (not illustrated) fixed to the vehicle body. In this case, even when the outside handle 21 is subjected to a rotating operation from an initial position (position illustrated in FIG. 1), the locking device 13 is held in the latched state. In comparison, in a case where the locking knob 14 is positioned at an unlocking position (position in FIG. 1), the locking device 13 enters an unlatched state in which the latch releases the striker when the outside handle 21 is caused to rotate from the initial position to the vehicle exterior side and is caused to move to an operational position (not illustrated). Hence, it is possible to cause the vehicle door 10 to rotate in an opening direction with respect to the vehicle body.

Subsequently, a detailed structure of the handle device 20 will be described.

The handle device 20 includes, as large configurational members, the outside handle 21 (handle), a handle support member 23, a handle support arm 45, a linkage mechanism 47, an inertia lever 65, a torsion coil spring 81, and a protective cover 87.

The hard resin handle support member 23 is an integral molding product extending in a frontward-rearward direction as illustrated in FIGS. 2 to 5, 7 and the like.

The handle support member 23 includes a vehicle-exterior-side wall 24 that configures the vehicle-exterior-side surface and a ceiling wall 25 and a bottom wall 26 which project toward the vehicle interior side from an upper edge portion and a lower edge portion of the vehicle-exterior-side wall 24, respectively.

An arm target through-hole 28 is formed in a rear portion of the handle support member 23 and penetrates through the vehicle-exterior-side wall 24 in a vehicle width direction (vehicle interior-exterior direction). A linkage arm (not illustrated) is provided to protrude from a front portion of a vehicle-interior-side surface of the outside handle 21 and extends toward the vehicle interior side. The linkage arm penetrates to be relatively movable through the arm target through-hole 28 in the vehicle width direction.

A lower support shaft 30 having a circular cylinder shape is provided to protrude upwardly from an upper surface of the bottom wall 26. A projecting support piece 31 is provided on the vehicle-interior-side surface of the vehicle-exterior-side wall 24, is positioned directly above the lower support shaft 30 and projects toward the vehicle interior side. An upper support shaft 32 having a circular cylinder shape is provided to protrude upwardly from an upper surface of the projecting support piece 31 and the upper support shaft is provided to be coaxial to the lower support shaft 30.

Figure 9:
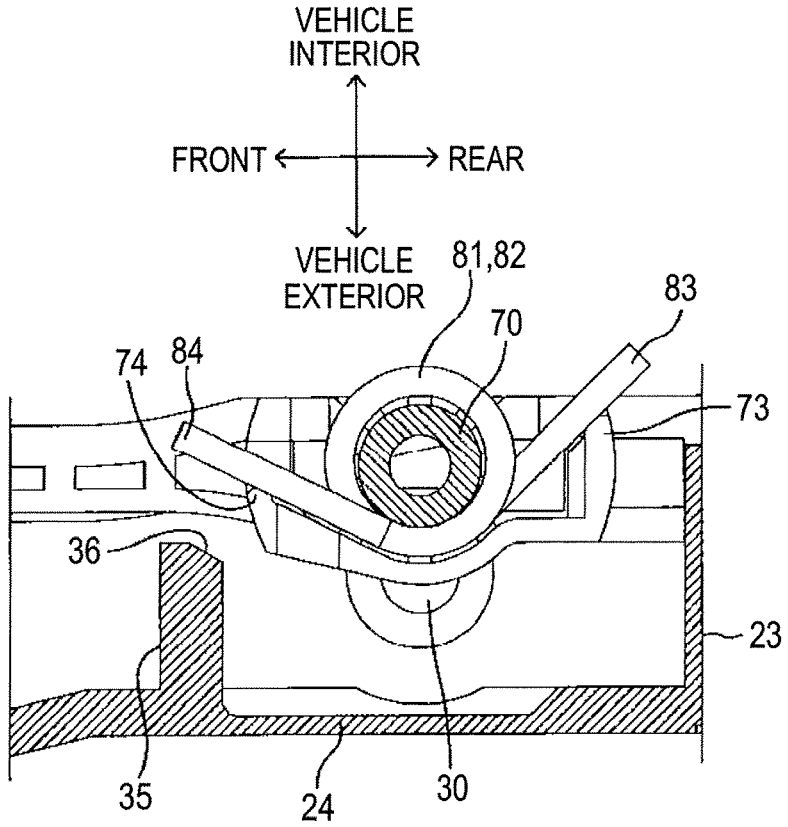
FIG. 9 is a sectional view illustrating a state during installation of the inertia lever integrated with the torsion coil spring to the handle support member, and illustrating the handle support member and the inertia lever taken along a horizontal plane.
Figure 10:
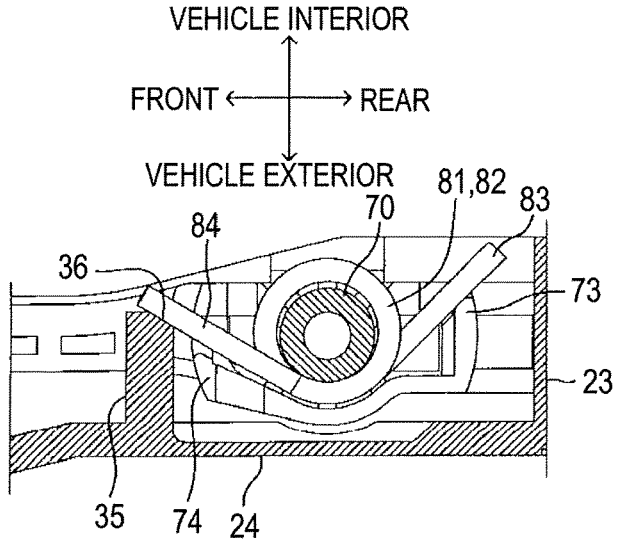
FIG. 10 is a sectional view similar to FIG. 9, illustrating a state in which the inertia lever and the torsion coil spring are installed to the handle support member.

A spring holding wall 34, which is positioned in the front side from the lower support shaft 30, is provided to protrude from an upper surface of the bottom wall 26, that is, from the vehicle-interior-side surface of the vehicle-exterior-side wall 24. As illustrated in figures, an upper portion of the spring holding wall 34 more recedes toward the vehicle exterior side than a lower portion thereof. The upper portion of the spring holding wall 34 configures a support-member-side engagement portion 35. As illustrated in FIGS. 9 and 10, the vehicle-interior-side surface of the support-member-side engagement portion 35 has an inclined surface 36 that inclines with respect to the frontward-rearward direction and the vehicle width direction when viewed in a perpendicular direction.

As illustrated in FIGS. 2 to 4 and 7, a pair of upper and lower handle support arms 45 are supported on both upper and lower surfaces of a front end portion of the handle support member 23. Specifically, one-side ends of the upper and lower handle support arms 45 are rotatably supported by the handle support member 23 via a rotary shaft 46 extending in the vertical direction.

It is possible to attach and detach, to and from the other-side ends of the upper and lower handle support arms 45, a connection portion (not illustrated) provided to protrude from a front end portion of the vehicle-interior-side surface of the outside handle 21.

The linkage mechanism 47 is provided in a rear portion of the handle support member 23. The linkage mechanism 47 includes, as main components, a bellcrank 48, a torsion coil spring 57, and a connection lever 62.

The bellcrank 48 includes a resin base portion 49, a connection shaft 53, and a metal counterweight 55.

A part of the base portion 49 is configured to have a rotating center shaft 50 having an axial line extending in the frontward-rearward direction. The rotating center shaft 50 is supported to be rotatable around the axial line thereof with respect to the handle support member 23.

Further, the base portion 49 has an input arm 51 and an output portion 52. The input arm 51 extends downwardly, a front end portion of the arm is positioned in the arm target through-hole 28, and the input arm is linked to the linkage arm of the outside handle 21 in the arm target through-hole 28. The output portion 52 is positioned above the rotating center shaft 50. The connection shaft 53, which penetrates through the output portion 52 in the frontward-rearward direction, is fixed to the output portion 52. A front end portion of the connection shaft 53 is configured of an abutment end portion 54 projecting toward the front side from a front end surface of the output portion 52.

An upper end portion of the bellcrank 48 is configured of the metal counterweight 55 fixed to the output portion 52. A configurational material of the counterweight 55 has the specific gravity which is greater than the base portion 49 and the connection shaft 53. Therefore, the bellcrank 48 has the gravity center which is positioned further on the upper side (the counterweight 55 side) than the rotating center shaft 50.

Since the input arm 51 of the linkage mechanism 47 is linked to the linkage arm of the outside handle 21, the bellcrank 48 is interlocked with the outside handle 21 and rotates. In other words, the bellcrank 48 is positioned at the initial position illustrated in FIGS. 2 to 5 when the outside handle 21 is positioned at the initial position, and the bellcrank is positioned at the operational position illustrated in FIG. 12 when the outside handle 21 is positioned at the operational position. In addition, the abutment end portion 54 is little shifted from a position in the vehicle width direction when the bellcrank 48 rotates from the initial position to the operational position, and the abutment end portion is positioned on the lower side, compared to the case where the bellcrank 48 is positioned at the initial position.

The torsion coil spring 57 is installed on the rotating center shaft 50 of the base portion 49. The torsion coil spring 57 has a cylindrical main body portion 58 having an axis extending in the frontward-rearward direction so as to have a spiral shape on the periphery of the rotating center shaft 50, and a first engagement piece 59 and a second engagement piece 60 which are provided to protrude from both ends of the main body portion 58, respectively. The first engagement piece 59 engages with the handle support member 23 and the second engagement piece 60 engages with the connection shaft 53. Further, since the main body portion 58 is elastically deformed from a free state, the torsion coil spring 57 normally applies an elastic force to the bellcrank 48.

The elastic force of the torsion coil spring 57 is a force in a direction in which the bellcrank 48 rotates and is biased toward the initial position. Further, as described above, the gravity center of the bellcrank 48 is positioned further on the upper side (counterweight 55 side) than the rotating center shaft 50. Hence, when no external force is applied to the outside handle 21 and the bellcrank 48 other than the force from the torsion coil spring 57, both of the outside handle 21 and the bellcrank 48 are held at the initial position by the bias force from the torsion coil spring 57 and the counterweight 55 of the bellcrank 48.

A rear end portion of the connection shaft 53 projects rearward from a rear end surface of the output portion 52. Then, an upper end portion of the connection lever 62 extending in the vertical direction is fixed to the rear end portion of the connection shaft 53. A lower end portion of the connection lever 62 is linked to an outside open lever not illustrated. The outside open lever is linked to the locking device 13. The connection lever 62 is positioned at the initial position illustrated in FIGS. 2 to 5 when the bellcrank 48 is positioned at the initial position, and the connection lever 62 is positioned at the operational position illustrated in FIG. 12 when the bellcrank 48 is positioned at the operational position. When the connection lever 62 is positioned at the initial position, the locking device 13 is held in the latched state. By comparison, in a case where the locking knob 14 is positioned at the unlocking position (position in FIG. 1), the locking device 13 is in the unlatched state when the connection lever 62 moves to the operational position.

The inertia lever 65 (rotary member) includes a resin lever main body 66. The lever main body 66 has a base portion 67 that configures the central portion thereof, a first arm 68 and a second arm 69 extending from the base portion 67 to the rear side and the front side, respectively, and a rotary shaft 70 that has a circular cylinder shape, extends downward from the base portion 67, and has an opened underside.

A stopper 71 is provided on a front end portion of the first arm 68. Further, a recessed portion 72 is provided in the front end portion of the first arm 68 so as to penetrate the first arm 68 in the vertical direction and to have an opened rear surface.

A first engagement portion 73 and a second engagement portion 74 are provided in a lower end portion of the base portion 67 so as to be positioned on an outer circumferential side of the rotary shaft 70 and to be separated from each other. A receiving hole 75 is formed at the central portion of the base portion 67 in the vertical direction so as to penetrate the base portion 67 in the vehicle width direction (a thickness direction of the lever main body 66). In addition, an upper end recessed portion 76 is formed in an upper end portion of the base portion 67 so as to have an opened upper surface and an opened vehicle-interior-side surface. A partition wall 77 having a horizontal plate shape is formed between the receiving hole 75 and the upper end recessed portion 76. Further, a rotation support hole 78 having a circular shape in cross section is formed in the partition wall 77 so as to penetrate through the partition wall 77 in the vertical direction.

Further, the inertia lever 65 is provided with a metal counterweight 79 fixed to a front end portion of the second arm 69. The counterweight 79 has a bar shape with an axis extending in the vertical direction. The counterweight 79 is made of materials having the specific gravity which is greater than that of the lever main body 66. Therefore, the inertia lever 65 has the gravity center which is positioned further on the front side (counterweight 79 side) than the rotary shaft 70.

The metal torsion coil spring 81, which is detachably installed on the inertia lever 65, integrally has a main body portion 82, a first engagement piece 83 and a second engagement piece 84. The main body portion 82 extends to have a spiral shape and a shape thereof is a circular cylinder shape having an axis extending in the vertical direction, overall. The first engagement piece 83 and the second engagement piece 84 extend in a straight line shape from both ends of the main body portion 82, respectively.

The inertia lever 65 and the torsion coil spring 81 are installed to the handle support member 23 in a state in which the inertia lever and the torsion coil spring are integrated with each other.

Figure 7:
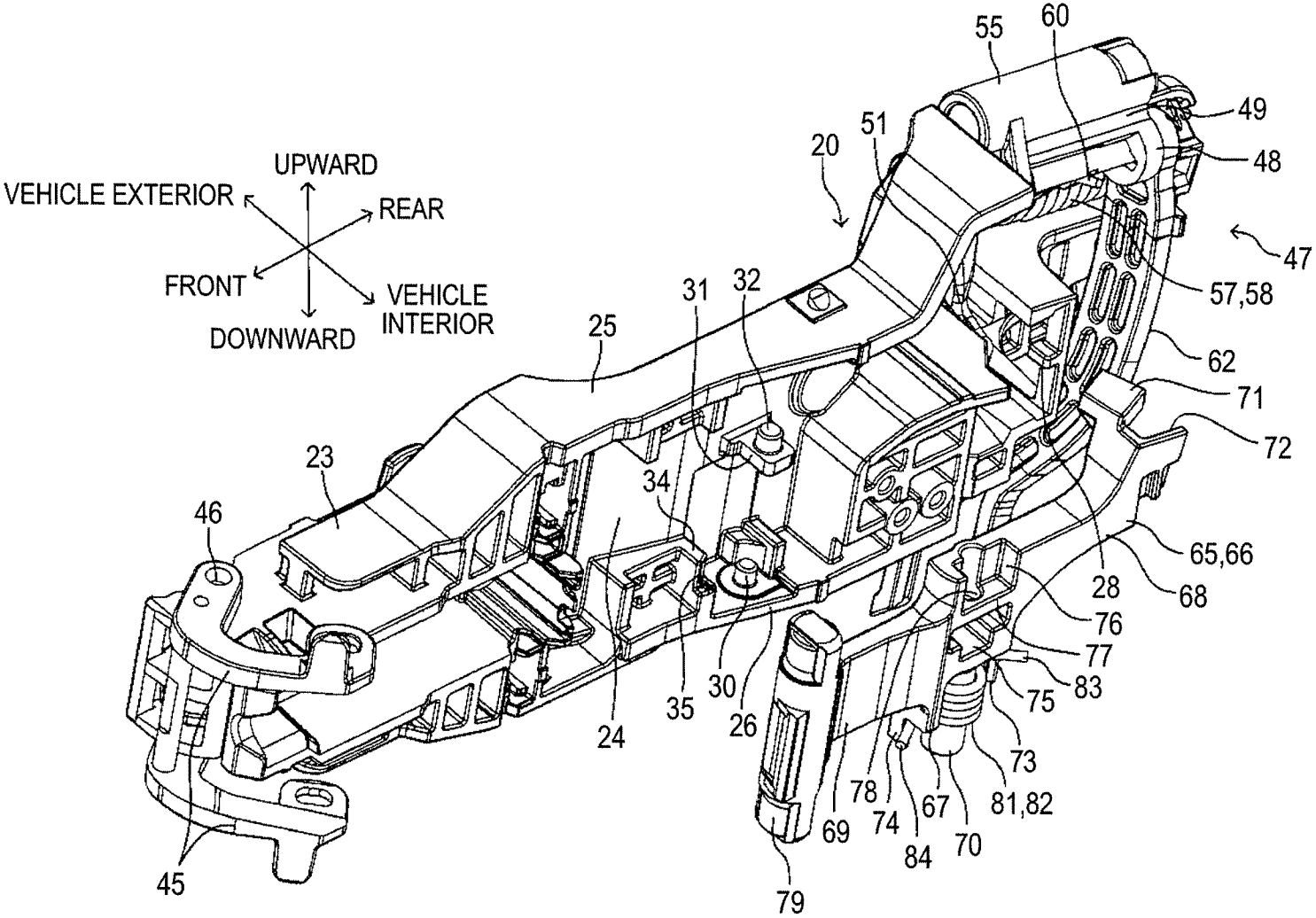
FIG. 7 is a perspective view of the handle device from which the protective cover is detached and in which an inertia lever and a torsion coil spring are separated from a handle support member, when viewed from the vehicle interior side.
Figure 8:
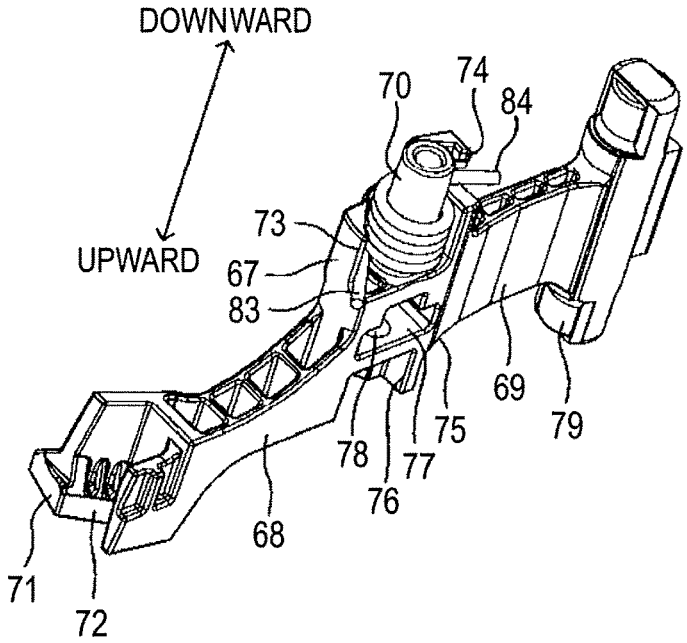
FIG. 8 is a perspective view of the inertia lever and the torsion coil spring which are integrated with each other, when viewed from below.

When the torsion coil spring 81 is to be installed on the inertia lever 65, first, the rotary shaft 70 is loosely fitted into the main body portion 82 from above. Subsequently, as illustrated in FIGS. 7 to 9, the first engagement piece 83 and the second engagement piece 84 engage with the first engagement portion 73 and the second engagement portion 74, respectively. Then, the main body portion 82 is elastically deformed from the free state, thereby generating a rotational bias force in a direction in which the first engagement piece 83 and the second engagement piece 84 press the first engagement portion 73 and the second engagement portion 74, respectively. Hence, relative rotation of the torsion coil spring 81 with respect to the inertia lever 65 is regulated.

When the inertia lever 65 and the torsion coil spring 81, which are integrated with each other as described above, are to be attached to the handle support member 23, first, the torsion coil spring 81 is caused to approach the central portion of the handle support member 23 from the vehicle interior side as illustrated in FIGS. 7 and 9, and the projecting support piece 31 and the upper support shaft 32 are inserted into the receiving hole 75. Then, as illustrated in FIG. 10, the rotary shaft 70 is positioned directly above the lower support shaft 30 and the rotary shaft 70 and the lower support shaft 30 are coaxial to each other. Further, while the inertia lever 65 moves from the position in FIG. 9 to the position in FIG. 10, the second engagement piece 84 of the torsion coil spring 81 comes into contact with the inclined surface 36 of the support-member-side engagement portion 35 of the handle support member 23 from the vehicle interior side. When the inertia lever 65 is caused to move to the position in FIG. 10 from the state described above, the second engagement piece 84 moves to the vehicle interior side from the second engagement portion 74 against the rotational bias force from the main body portion 82 with the second engagement piece 84 in contact with the inclined surface 36.

Figure 5:
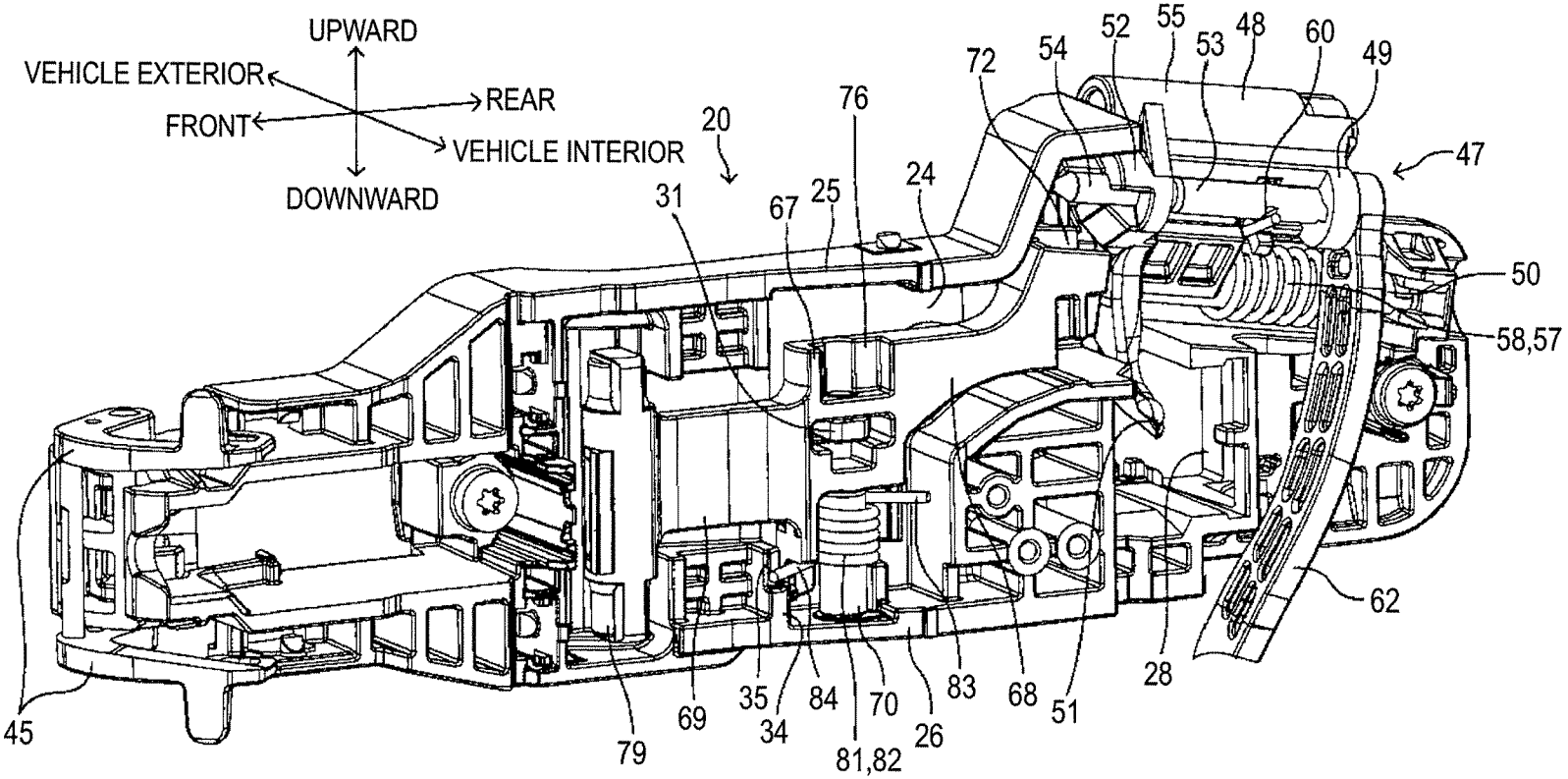
FIG. 5 is a perspective view of the handle device from which the protective cover is detached, when viewed from the vehicle interior side.

Subsequently, the inertia lever 65 and the torsion coil spring 81 are caused to move downwardly from the state described above, the lower support shaft 30 is rotatably fitted into the inside the rotary shaft 70 through a lower end opening of the rotary shaft 70 as illustrated in FIG. 5, and further the upper support shaft 32 is rotatably fitted into the rotation support hole 78 from below.

Figure 11:
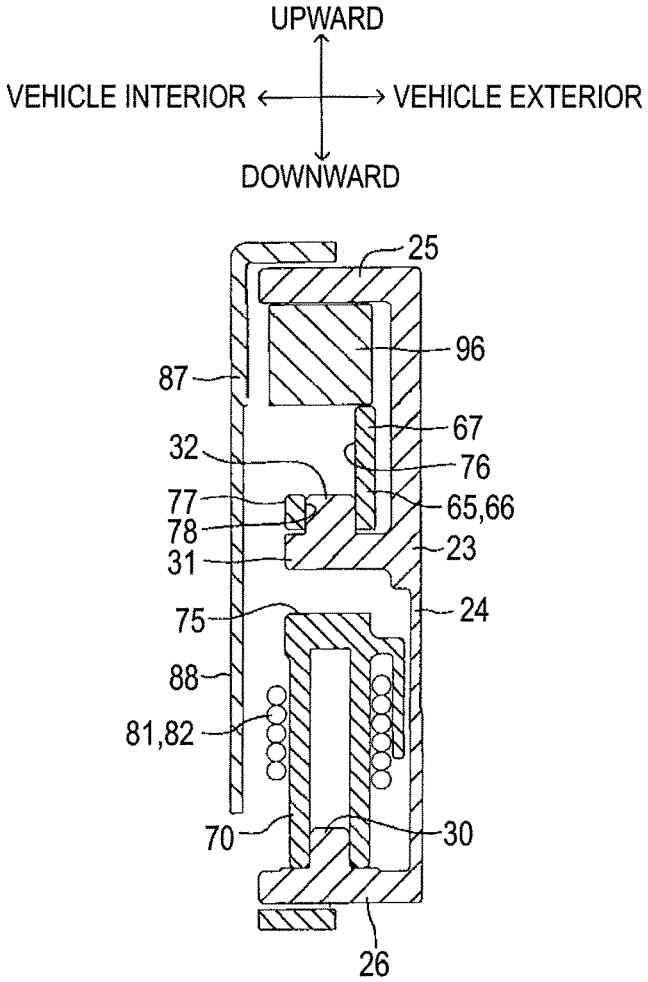
FIG. 11 is a sectional view taken along arrows XI-XI in FIG. 2.

In this manner, when the inertia lever 65 is attached to the handle support member 23, a holding member 96 which is separate from the handle support member 23 (and the protective cover 87 to be described below) is inserted between an underside of the ceiling wall 25 of the handle support member 23 and the upper end surface of the base portion 67 of the inertia lever 65 as illustrated in FIG. 11. Further, the holding member 96 and the handle support member 23 are fixed to each other by means of adhesion or the like. As a result, the holding member 96 regulates the inertia lever 65 from moving upwardly with respect to the handle support member 23 (the lower support shaft 30 and the projecting support piece 31). Hence, there is little concern that the inertia lever 65 will fall from the handle support member 23 (the lower support shaft 30 and the projecting support piece 31).

Figure 6:
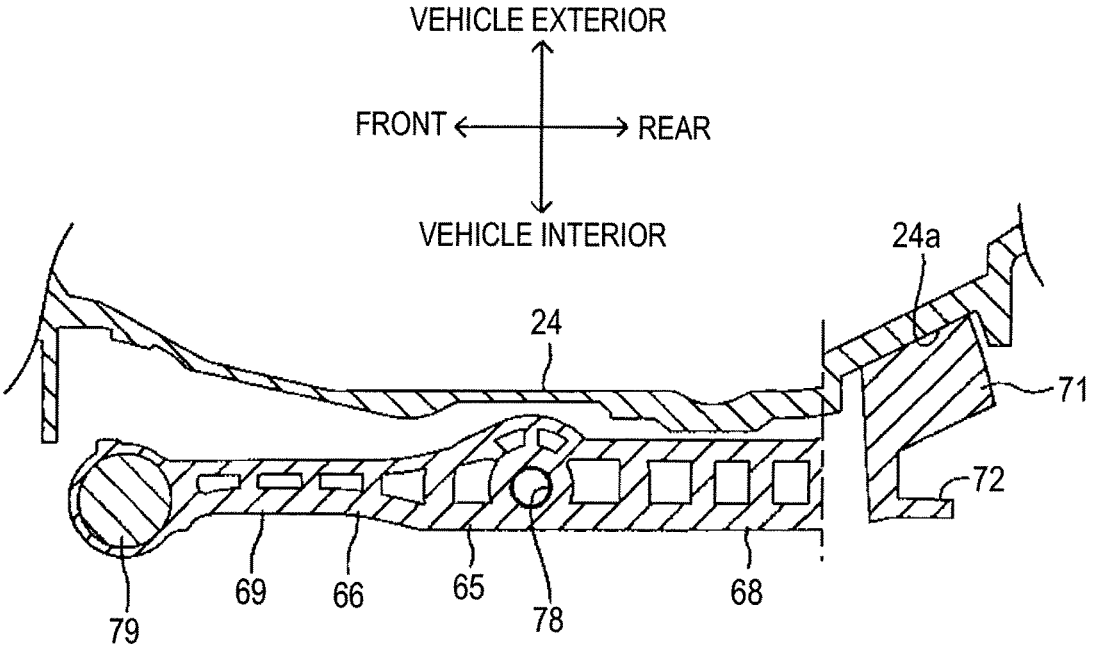
FIG. 6 is a sectional view taken along arrows VI-VI in FIG. 4.
Figure 12:
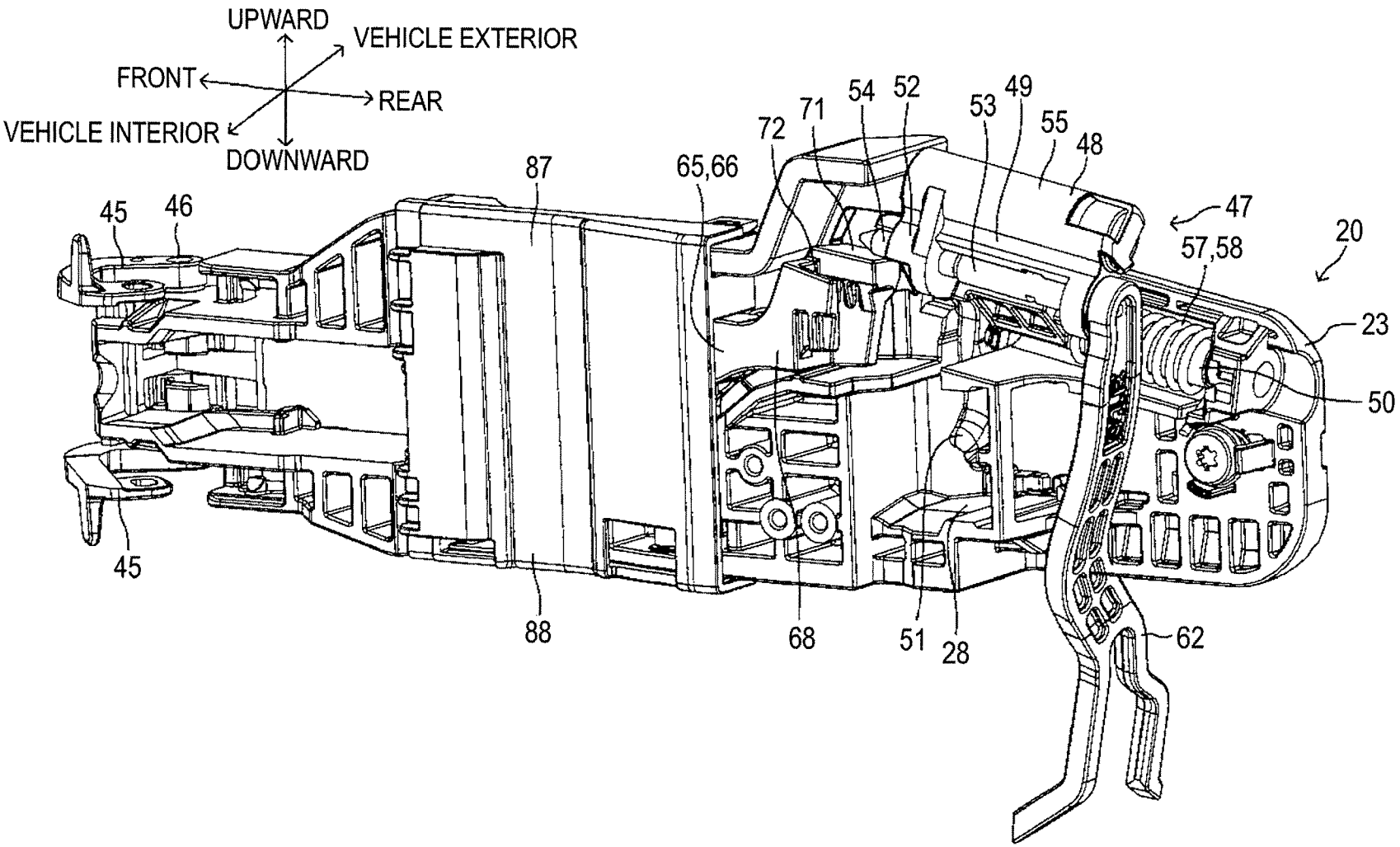
FIG. 12 is a perspective view similar to FIG. 3, illustrating a state in which a vehicle, in which a vehicle handle is mounted, collides with another vehicle.
Figure 13:
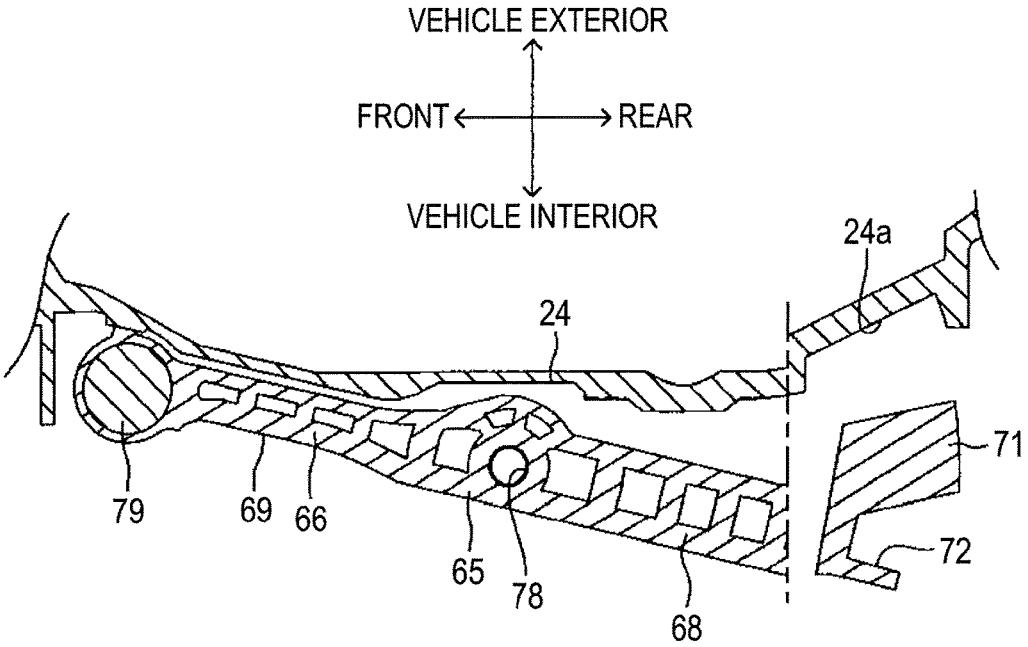
FIG. 13 is a sectional view similar to FIG. 6, illustrating a state in which the vehicle, in which the vehicle handle is mounted, collides with another vehicle.
Figure 14:
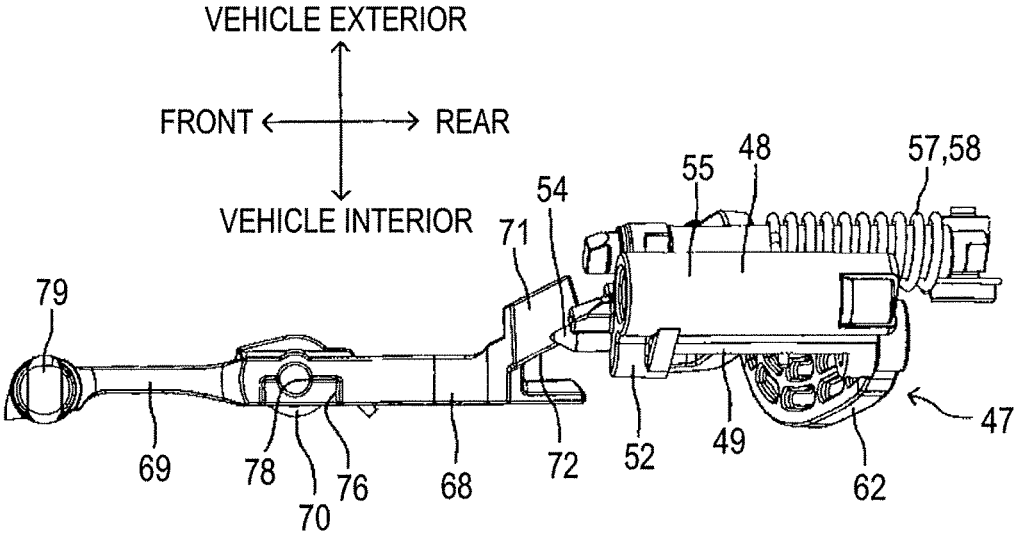
FIG. 14 is a plan view illustrating a linkage mechanism, the inertia lever, and the protective cover when the vehicle, in which the vehicle handle is mounted, collides with another vehicle.

In this manner, when the inertia lever 65 is attached to the handle support member 23, the inertia lever 65 is able to rotate with respect to the handle support member 23 between the non-regulation position illustrated in FIGS. 2 to 6 and the regulation position illustrated in FIGS. 12 to 14. As illustrated in FIG. 6, the non-regulation position of the inertia lever 65 is defined with an end surface of the stopper 71 on the vehicle exterior side in contact with a stopper surface 24*a* formed on the vehicle-exterior-side wall 24. Further, since the first engagement piece 83 of the torsion coil spring 81 engages with the first engagement portion 73 of the inertia lever 65 and the second engagement piece 84 engages with the inclined surface 36 of the support-member-side engagement portion 35 of the handle support member 23, the rotational bias force from the torsion coil spring 81 is applied to the handle support member 23 and the inertia lever 65. The rotational bias force from the torsion coil spring 81 is applied in a direction in which the inertia lever 65 is caused to rotate in a counterclockwise direction with respect to the handle support member 23 in a plan view. Therefore, when no external force is applied to the inertia lever 65 other than the rotational bias force from the torsion coil spring 81, the inertia lever 65 is held at the non-regulation position.

Figure 3:
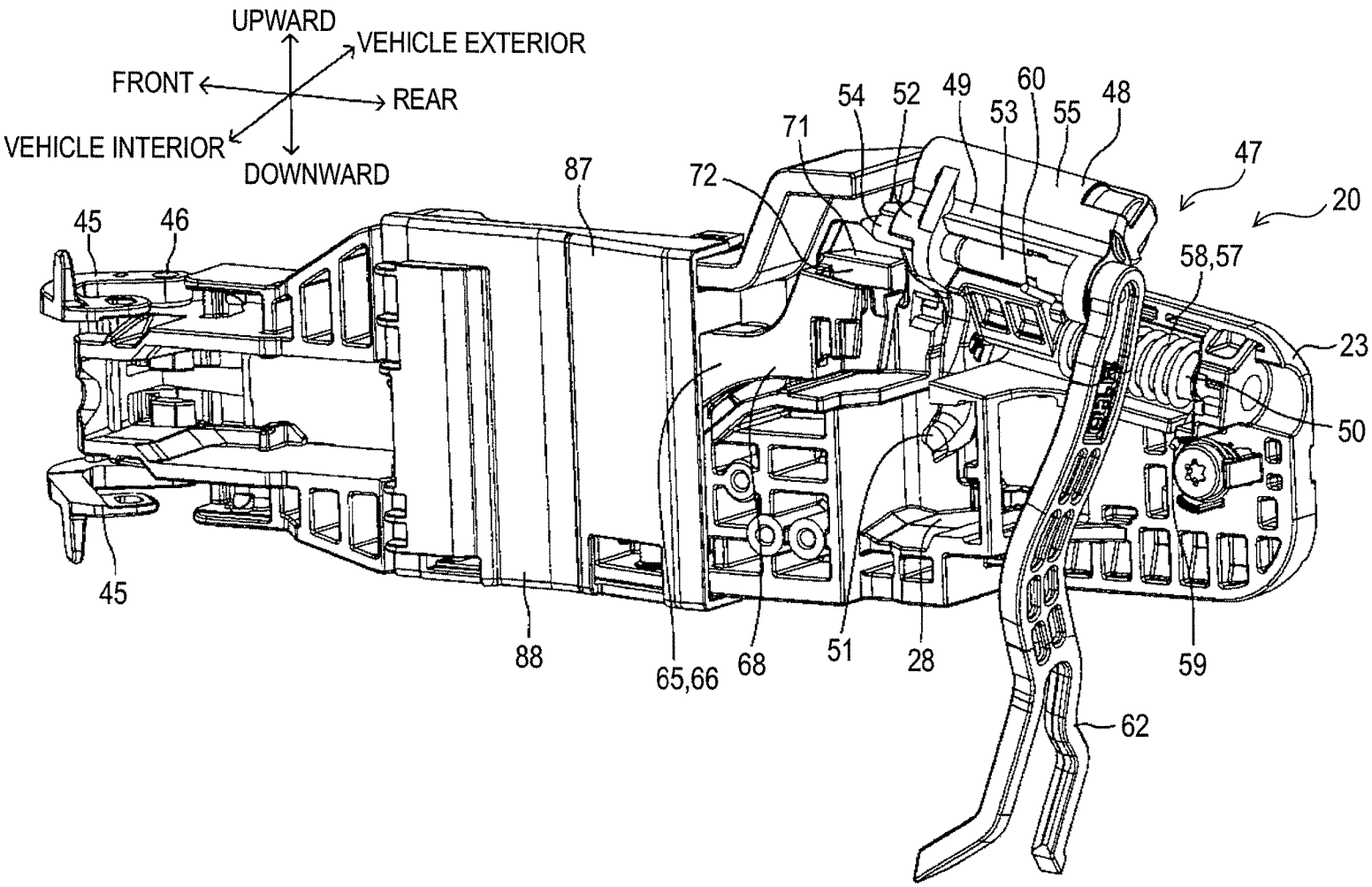
FIG. 3 is a perspective view of the handle device when viewed from the vehicle interior side.
Figure 4:
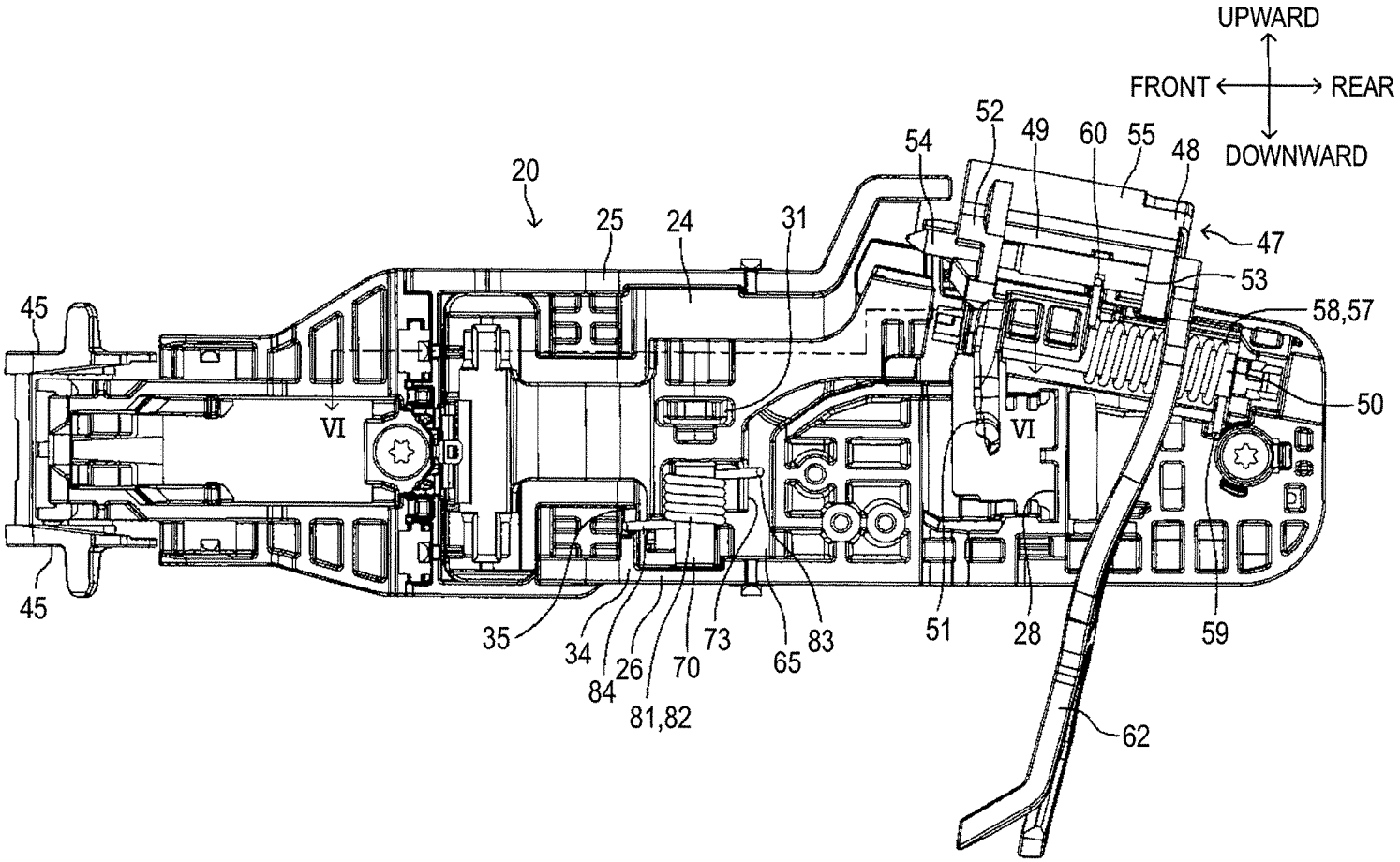
FIG. 4 is a side view of the handle device from which a protective cover is detached, when viewed from the vehicle interior side.

In addition, as illustrated in FIGS. 3 and 5, in the case where the inertia lever 65 is positioned at the non-regulation position, the abutment end portion 54 of the bellcrank 48 and the recessed portion 72 of the lever main body 66 are disposed at the same position in the vehicle width direction even when the bellcrank 48 is positioned at any one of the initial position or the operational position. In addition, as illustrated in FIGS. 12 and 14, in the case where the inertia lever 65 is positioned at the regulation position, the abutment end portion 54 of the bellcrank 48 and the stopper 71 of the lever main body 66 are disposed at the same position in the vehicle width direction even when the bellcrank 48 is positioned at any one of the initial position or the operational position.

The resin protective cover 87 is detachably installed on the vehicle-interior-side surface of the handle support member 23.

The protective cover 87 has a substrate portion 88 having a substantial rectangular shape in side shape.

The protective cover 87 covers (most of) the inertia lever 65 and the torsion coil spring 81 with the substrate portion 88 from the vehicle interior side and is installed to the handle support member 23. The handle support member 23 and the protective cover 87 have engagement portions through which the handle support member and the protective cover engage with each other. Therefore, there is little concern that the protective cover 87 will unexpectedly fall from the handle support member 23.

The handle device 20 has the configuration described above in which the outside handle 21 (handle), the handle support member 23, the handle support arm 45, the linkage mechanism 47, the inertia lever 65, the torsion coil spring 81, and the protective cover 87 are assembled together and then are fixed to the outer panel 12.

Figure 2:
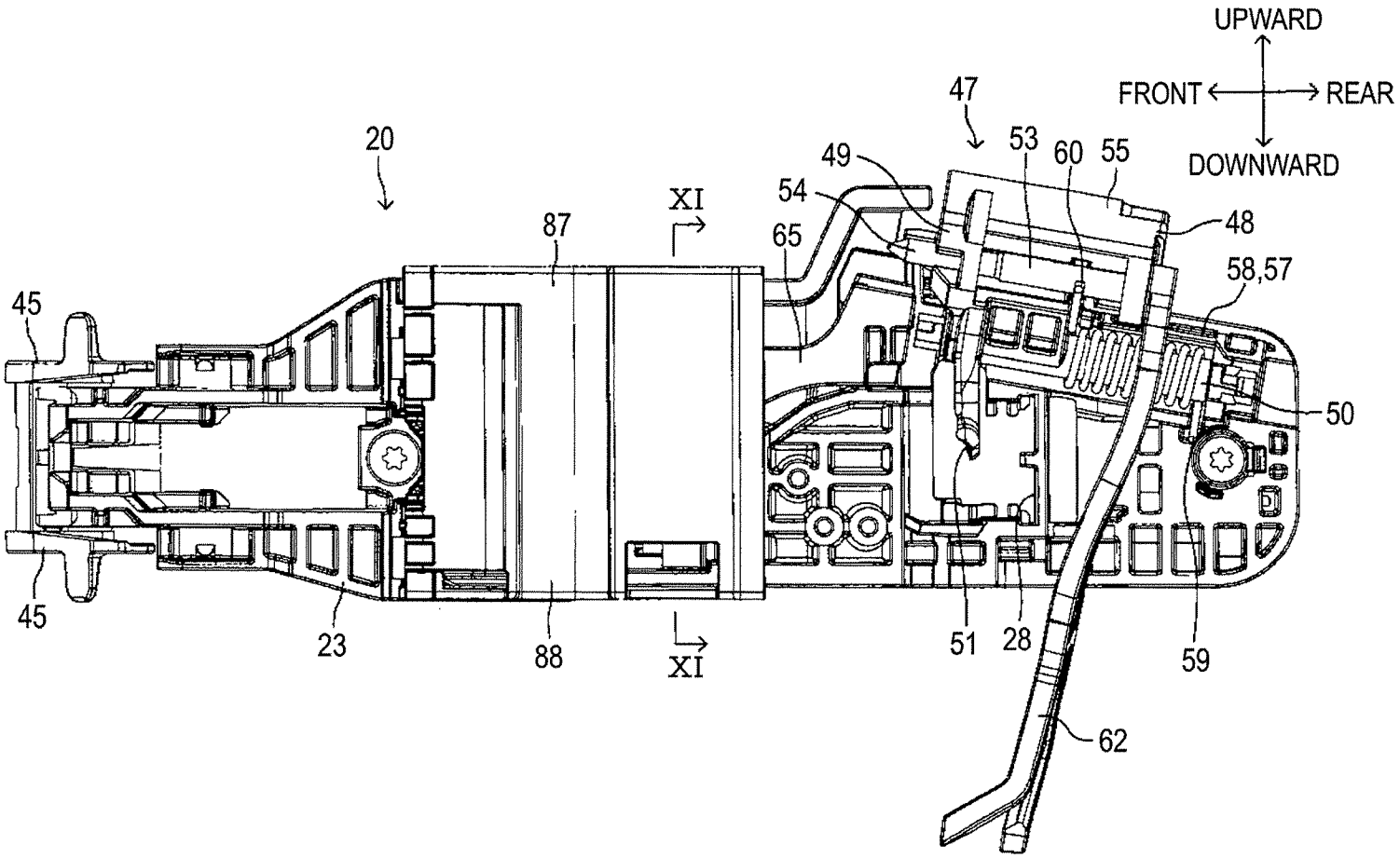
FIG. 2 is a side view of a handle device when viewed from a vehicle interior side.

At this time, while an operator has to hold the handle device 20, the operator has to fix the handle device 20 to the outer panel 12. However, as illustrated in FIGS. 2, 3, and 12, since (most of) the inertia lever 65 and the torsion coil spring 81 are covered from the vehicle interior side with the protective cover 87, there is little concern that an operator mistakenly rotates the inertia lever 65 to the regulation position by hand.

Further, when the handle device 20 is fixed to the outer panel 12, the connection portion in the front end portion of the outside handle 21 is positioned on the vehicle interior side of the outer panel 12 through a through-hole formed in the outer panel 12 and is connected to the other-side ends of the upper and lower handle support arms 45.

The inertia lever 65 and the torsion coil spring 81 of the handle device 20 attached to the vehicle door 10 have the following functions.

For example, when the vehicle, in which the handle device 20 (vehicle door 10) is mounted, collides with another vehicle, the inertia may act on the handle device 20 (substantially) in the same direction as the moving direction of the outside handle 21 from the initial position to the operational position. When the inertia exceeds the rotational bias force from the torsion coil spring 81, the inertia lever 65 rotates from the non-regulation position to the regulation position due to the inertia. Since the inertia lever 65 is provided with the counterweight 79, the inertia lever 65 swiftly rotates to the regulation position side due to the inertia. In other words, before the outside handle 21 and the bellcrank 48 move from the initial position to the operational position due to the inertia, the inertia lever 65 moves from the non-regulation position to the regulation position. Hence, since the abutment end portion 54 of the bellcrank 48 rotating to the operational position due to the inertia collides with the stopper 71 of the inertia lever 65 from above, the bellcrank 48 and the outside handle 21 are not able to rotate to the operational position. In other words, it is possible to decrease a concern, with the inertia lever 65 and the torsion coil spring 81, that the locking device 13 will unexpectedly enter the switching mode from the latched state to the unlatched state due to the collision of the vehicle.

By comparison, since no external force is applied to the inertia lever 65 other than the rotational bias force from the torsion coil spring 81 when the vehicle is in the normal state (collision or the like does not occur), the inertia lever 65 is held at the non-regulation position. As described above, at this time the abutment end portion 54 of the bellcrank 48 and the recessed portion 72 of the lever main body 66 are disposed at the same position in the vehicle width direction. Therefore, in this case, when an occupant in the vehicle rotates the outside handle 21 positioned at the initial position to the operational position, the abutment end portion 54 passes through the lower side from the recessed portion 72 and the bellcrank 48 rotates to the operational position. In other words, when the inertia lever 65 is positioned at the non-regulation position, it is possible to intentionally cause the locking device 13 to perform a transition to the unlatched state by using the outside handle 21.

In the embodiment described above, while the relative rotation of the torsion coil spring 81 with respect to the inertia lever 65 is regulated, the inertia lever 65 and the torsion coil spring 81 are installed to the handle support member 23. Therefore, there is a decrease in concern that, for example, the second engagement piece 84 will hook on a portion of the handle support member 23 other than the support-member-side engagement portion 35 during the attachment work of the inertia lever 65 and the torsion coil spring 81 to the handle support member 23 and, as a result, it is not possible to install the inertia lever 65 to the lower support shaft 30 and the upper support shaft 32 of the handle support member 23.

However, when the inertia lever 65 is installed to the lower support shaft 30 and the upper support shaft 32, the second engagement piece 84 of the torsion coil spring 81 comes into contact with the support-member-side engagement portion 35 (inclined surface 36) of the handle support member 23, and thereby the second engagement piece is automatically separated from the second engagement portion 74 and automatically engages with the support-member-side engagement portion 35. In other words, only the installation of the inertia lever 65 to the handle support member 23 enables the inertia lever 65 to be installed to the handle support member 23 and, further, enables the second engagement piece 84 of the torsion coil spring 81 to engage with the support-member-side engagement portion 35 of the handle support member 23.

Therefore, it is possible to easily install the inertia lever 65 and the torsion coil spring 81 to the handle support member 23 such that the torsion coil spring 81 is able to cause the inertia lever 65 to rotate and be biased.

Subsequently, a second embodiment disclosed here will be described with reference to FIGS. 15 to 20. Note that the same reference signs as in the first embodiment are assigned to the members corresponding to those in the first embodiment, and detailed description thereof is omitted. Note that the "corresponding members" include not only completely the same member as that in the first embodiment, but also include a member which has basically the same function in spite of having a slightly different shape from that in the first embodiment.

The embodiment is characterized in that a handle support member 110 and an inertia lever 120 (rotary member) have shapes different from those in the first embodiment, a rotating center bar 130 is provided, and the holding member 96 and the protective cover 87 are not provided.

The handle support member 110 is not provided with the lower support shaft 30, the projecting support piece 31, and the upper support shaft 32. By comparison, circular through-holes 111 and 112 which are coaxial to each other are formed in the ceiling wall 25 and the bottom wall 26 of the handle support member 110.

Figure 15:
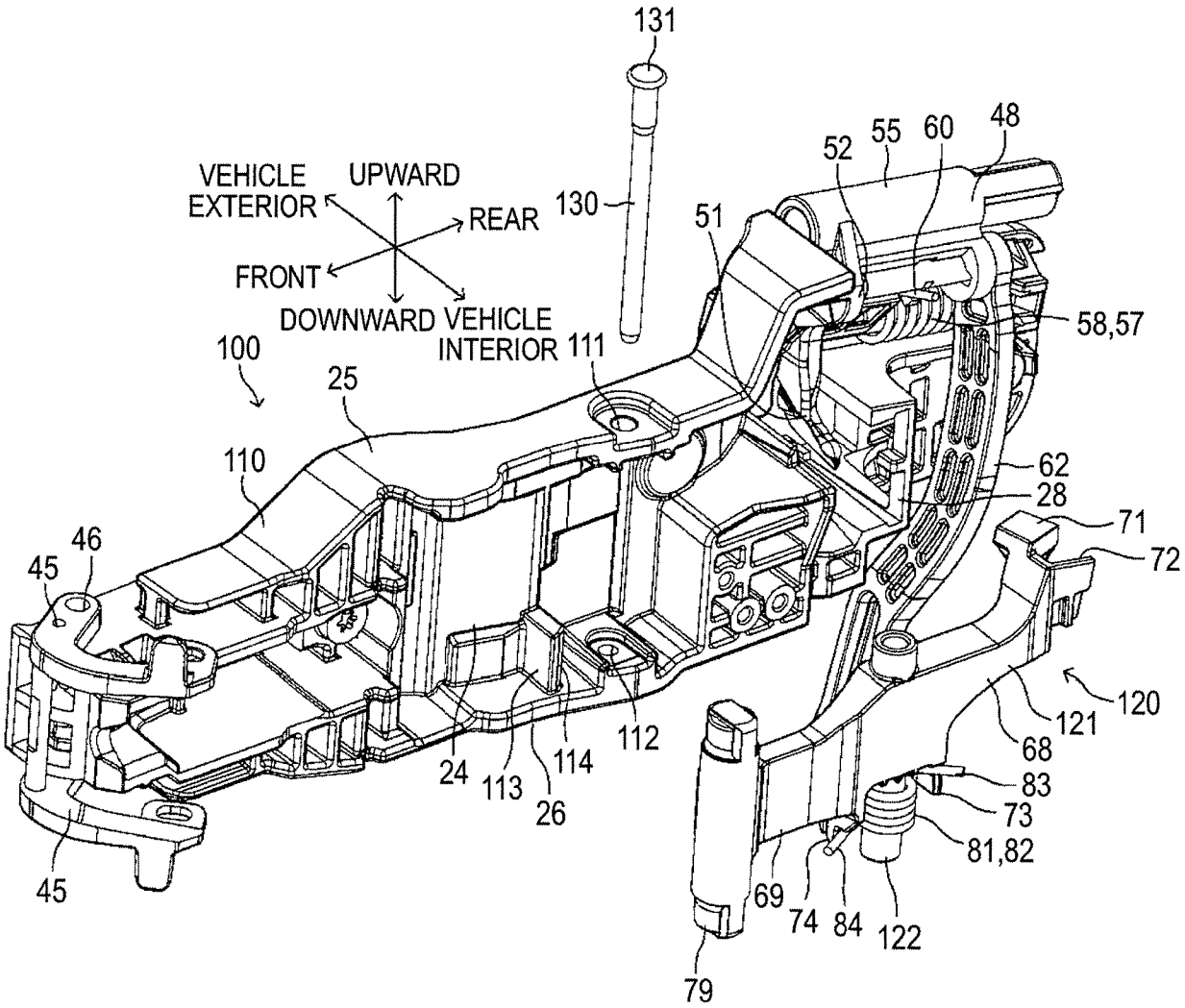
FIG. 15 is a perspective view of a handle device when an inertia lever and a rotating center shaft are separated from a handle support member of a second embodiment disclosed here, when viewed from the vehicle interior side.
Figure 16:
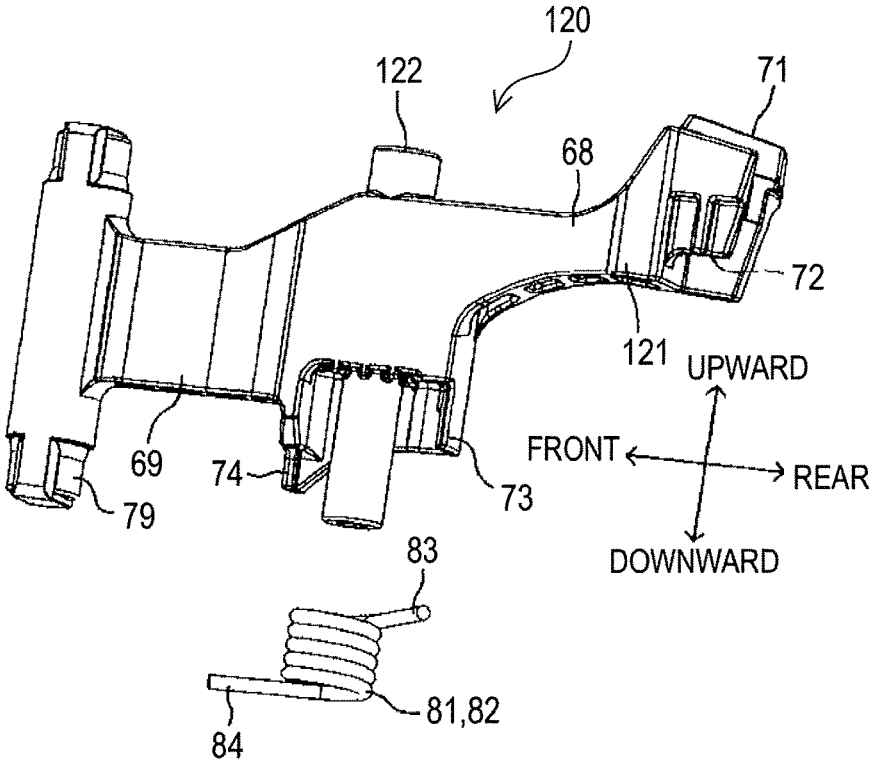
FIG. 16 is a perspective view of the inertia lever and the torsion coil spring which are separated from each other, when viewed from the vehicle interior side.
Figure 17:
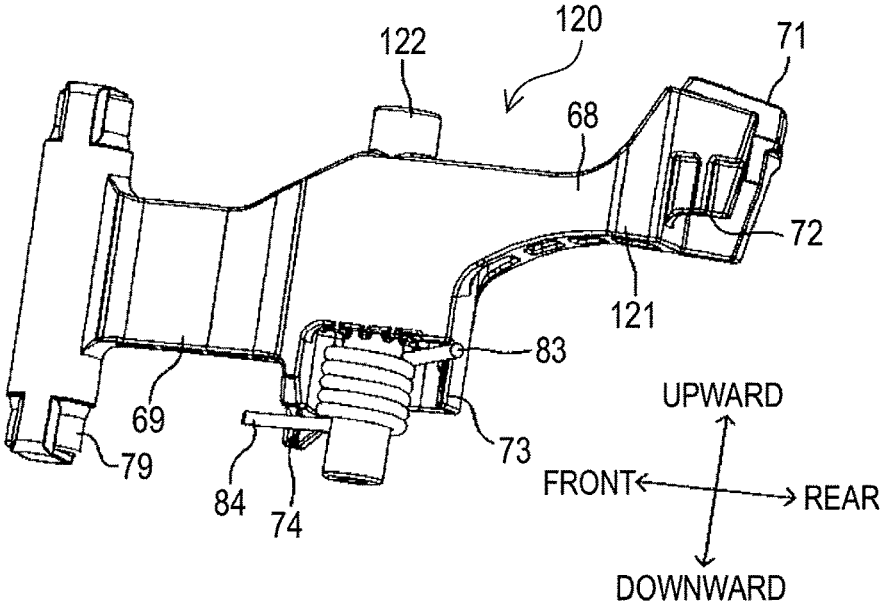
FIG. 17 is a perspective view of the inertia lever and the torsion coil spring which are integrated with each other, when viewed from the vehicle interior side.
Figure 18:
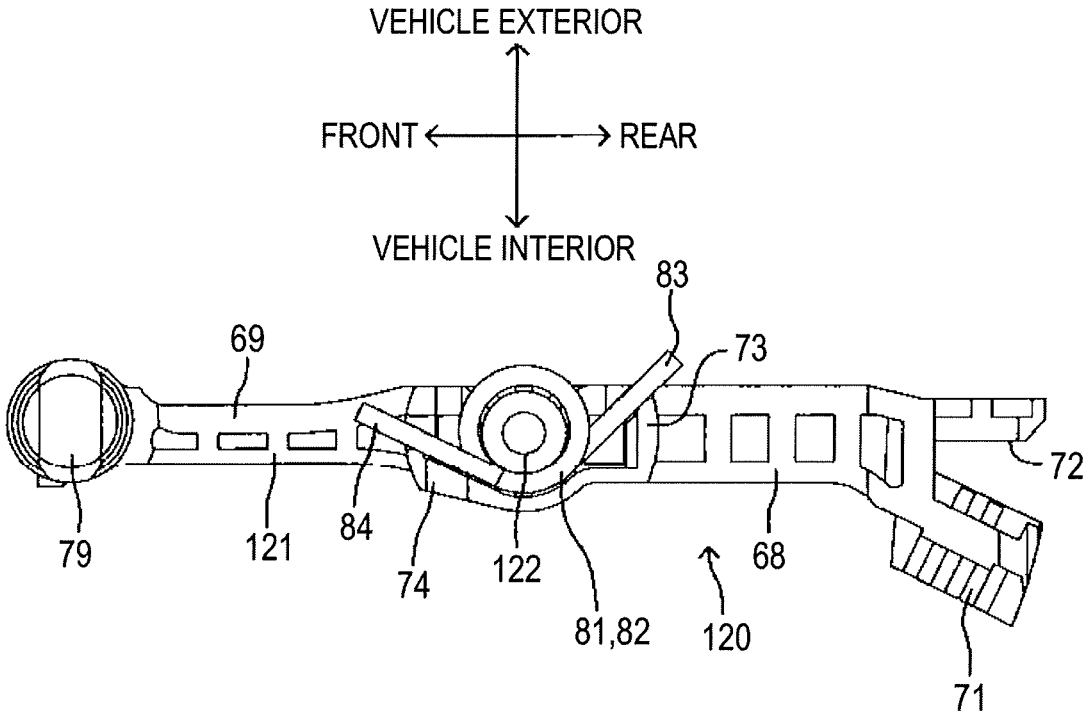
FIG. 18 is a bottom view illustrating the inertia lever and the torsion coil spring which are integrated with each other.
Figure 19:
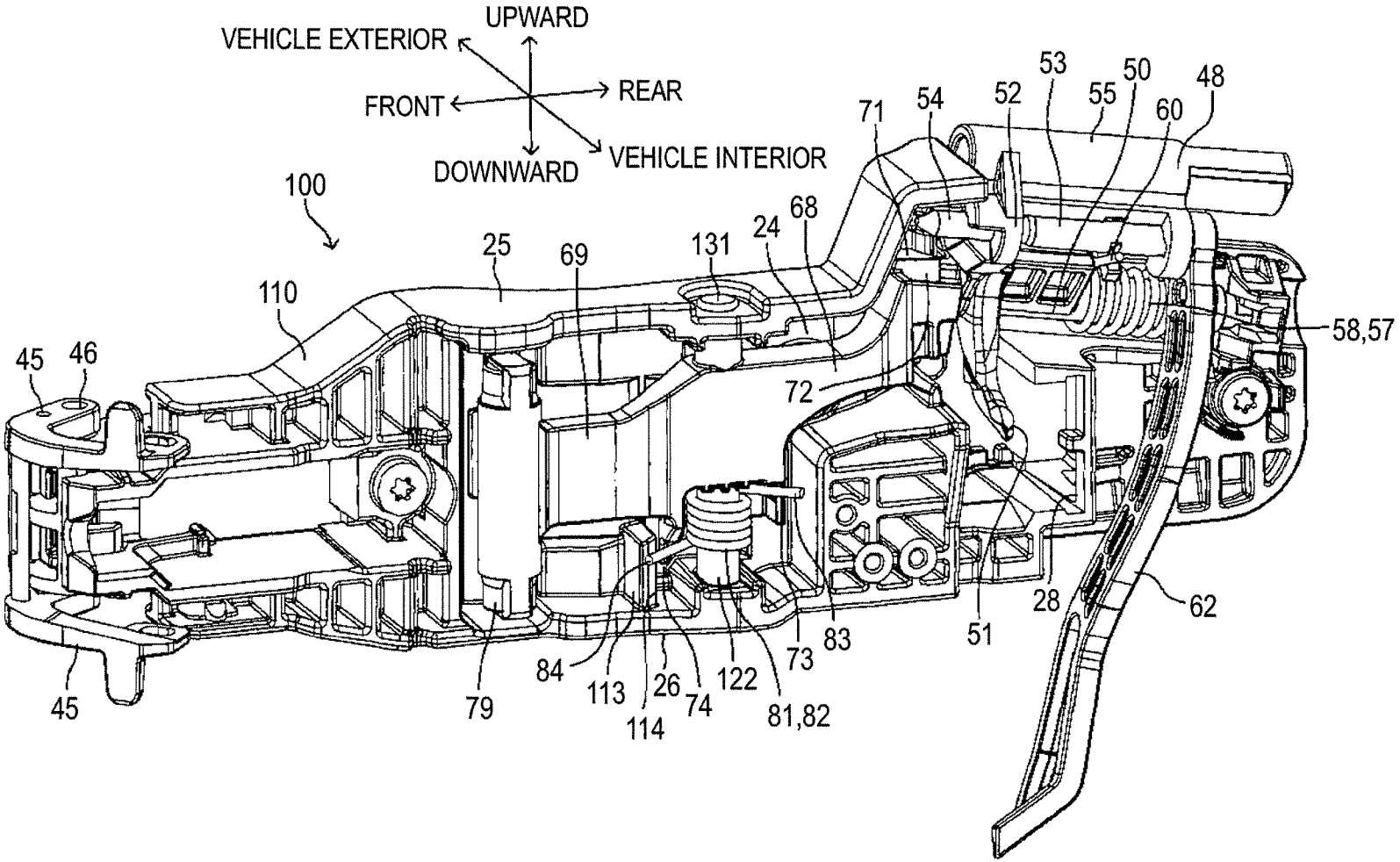
FIG. 19 is a perspective view of the handle device immediately after the inertia lever and the rotating center shaft are installed to the handle support member, when viewed from the vehicle interior side.
Figure 20:
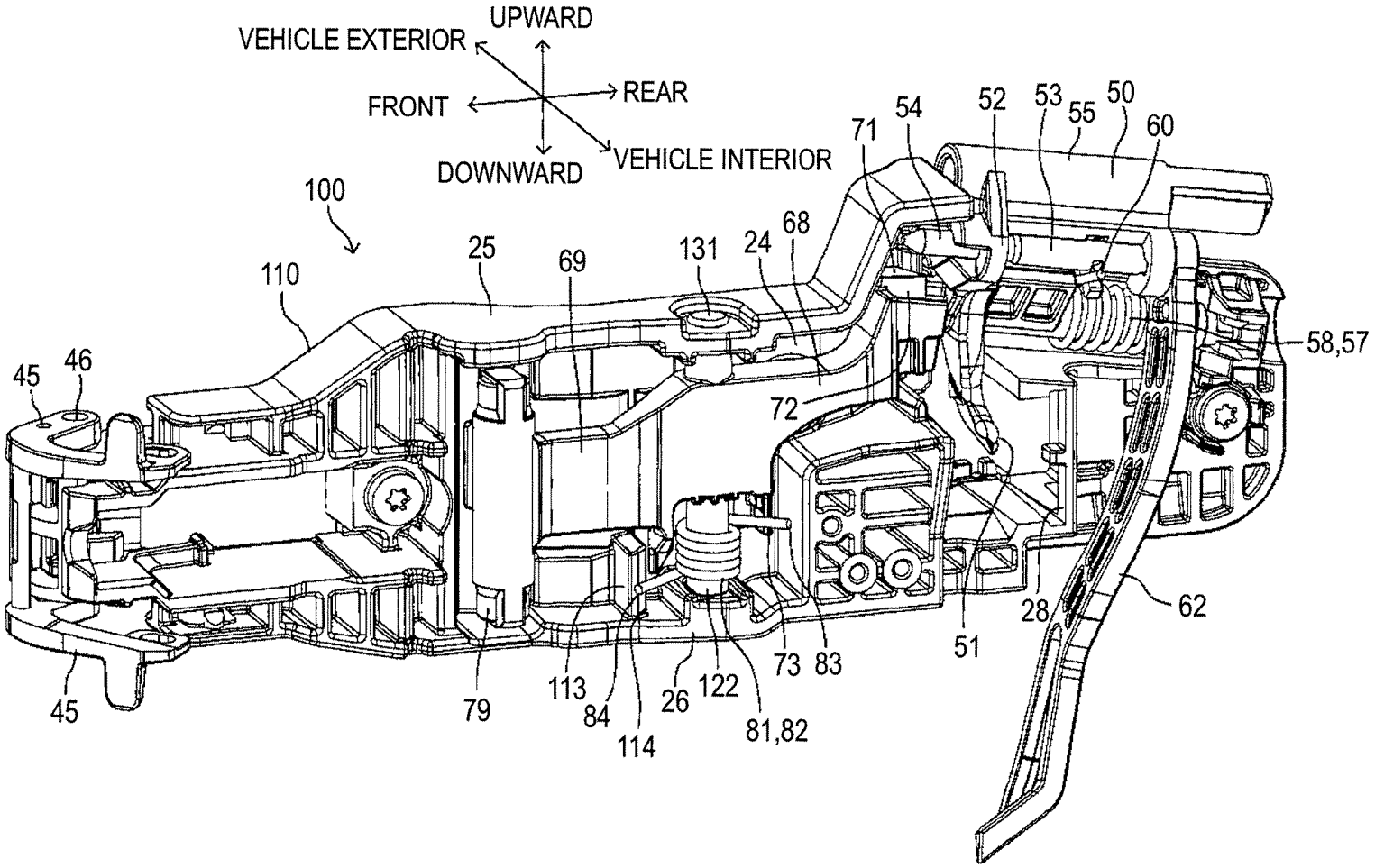
FIG. 20 is a perspective view of the handle device which is completely assembled from the state in FIG. 19 by causing the torsion coil spring to move downward, when viewed from the vehicle interior side.
Figure 21:
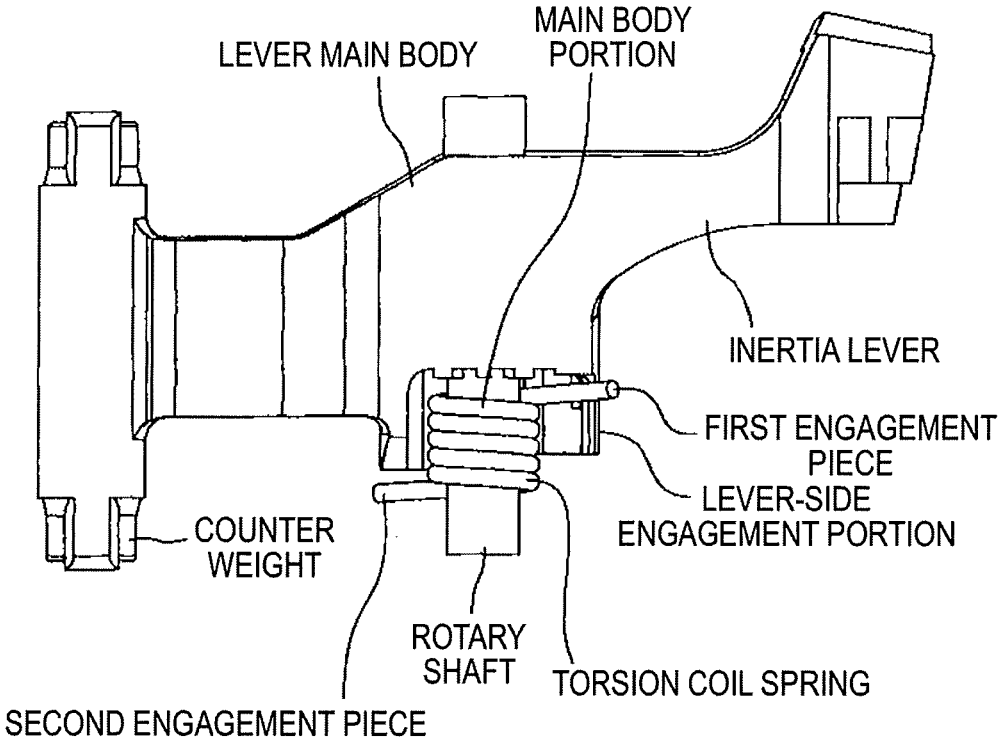
FIG. 21 is a side view illustrating an inertia lever and a torsion coil spring which are integrated with each other, according to a comparative example.
Figure 22:
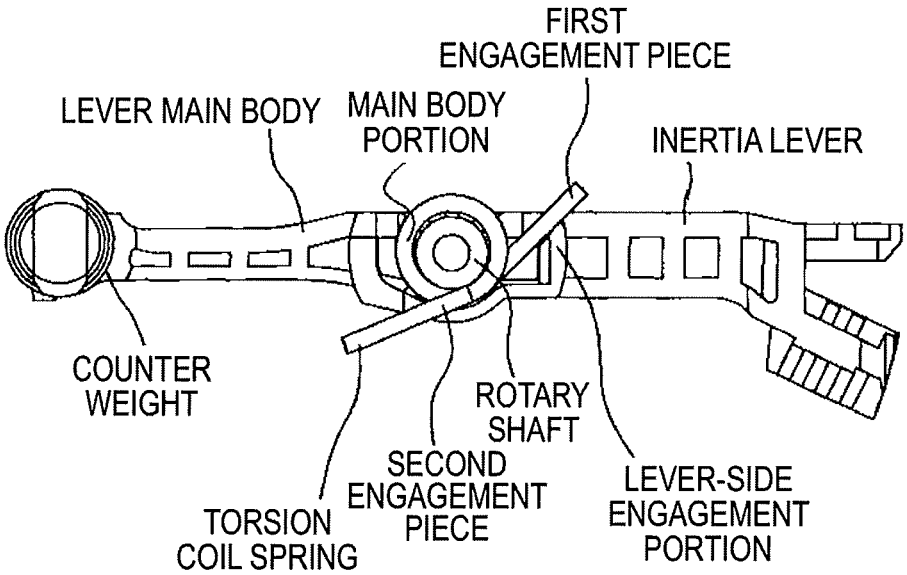
FIG. 22 is a bottom view illustrating the inertia lever and the torsion coil spring which are integrated with each other, according to the comparative example.
Figure 23:
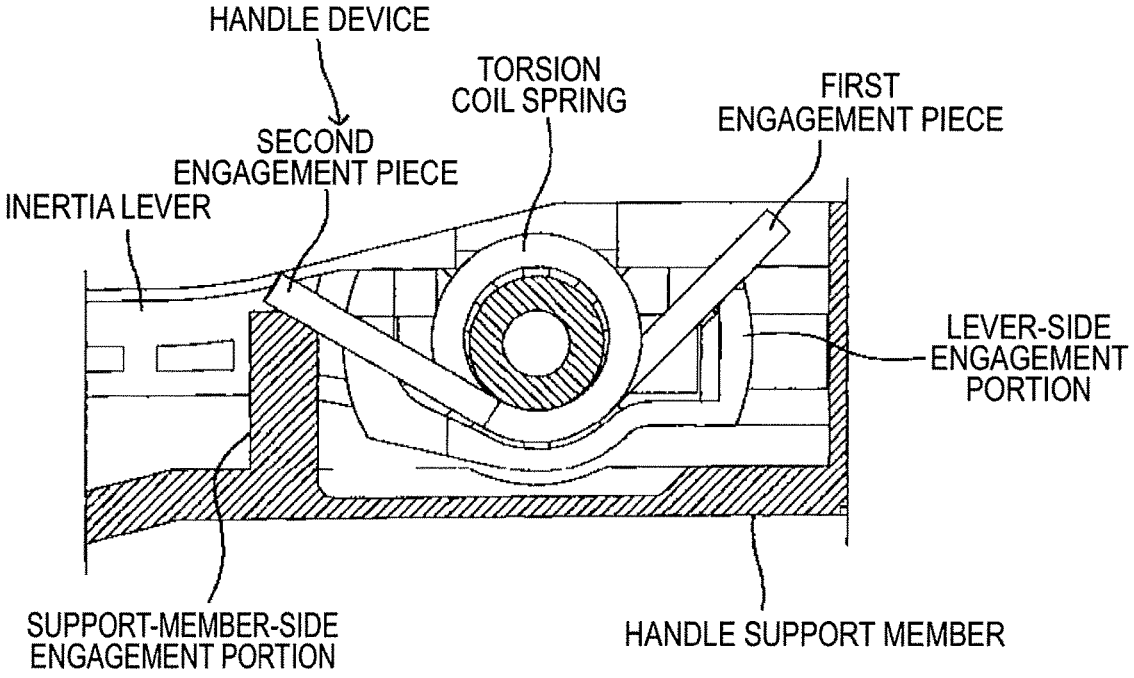
FIG. 23 is a sectional view illustrating the handle device when the inertia lever and the torsion coil spring are installed to the handle support member.

A support-member-side engagement portion 113, which is positioned in the front side from the through-hole 111 and the through-hole 112, is provided to protrude from an upper surface of the bottom wall 26, that is, from the vehicle-interior-side surface of the vehicle-exterior-side wall 24. As illustrated in FIGS. 15, 19, and 20, the vehicle-interior-side surface of the support-member-side engagement portion 113 has an inclined surface 114 that inclines with respect to the frontward-rearward direction and the vehicle width direction when viewed in a perpendicular direction.

The inertia lever 120 is provided with a resin lever main body 121 and the metal counterweight 79.

A rotary shaft 122 is provided as a part of the lever main body 121 at the central portion of the lever main body 121 so as to penetrate through the central portion in the vertical direction. The rotary shaft 122 is a circular cylinder body and both of the upper and lower surfaces thereof are opened.

Note that the lever main body 121 does not have portions corresponding to the receiving hole 75, the upper end recessed portion 76, and the partition wall 77.

Similar to the first embodiment, the inertia lever 120 and the torsion coil spring 81 are integrated with each other in a state of being attached to the handle support member 110. In other words, the first engagement piece 83 and the second engagement piece 84 engage with the first engagement portion 73 and the second engagement portion 74 of the inertia lever 120, and thereby relative rotation of the torsion coil spring 81 with respect to the inertia lever 120 (rotary shaft 122) is regulated.

In the embodiment, the metal rotating center bar 130 is used for installing the inertia lever 120 to the handle support member 110. The rotating center bar 130 is a bar-shaped member having a circular shape in cross section, and has a head portion 131 on the top end portion of the bar. The head portion has a diameter larger than the other portion of the rotating center bar 130 and the through-hole 111.

In order to install the inertia lever 120 to the handle support member 110, first, the inertia lever 120, which is integrated with the torsion coil spring 81, is inserted into an inner space of the handle support member 110 such that the rotary shaft 122 is coaxial to the through-hole 111 and the through-hole 112.

Subsequently, a lower end portion of the rotating center bar 130 positioned above the handle support member 110 is inserted into the inside of the rotary shaft 122 through the through-hole 111 and an upper end opening of the rotary shaft 122, and the lower end portion is caused to project downwardly from a lower end opening of the rotary shaft 122 so as to be press-fitted into the through-hole 112 (refer to FIG. 19). When the lower end portion of the rotating center bar 130 is press-fitted into the through-hole 112, relative rotation of the rotating center bar 130 with respect to the through-hole 112 is regulated.

In this manner, when the inertia lever 120 is attached to the handle support member 110 by using the rotating center bar 130, the inertia lever 120 is able to rotate with respect to the handle support member 110 between the non-regulation position illustrated in FIGS. 19 and 20 and the regulation position not illustrated.

In a state immediately after the inertia lever 120 illustrated in FIG. 19 is installed to the handle support member 110, the second engagement piece 84 of the torsion coil spring 81 engages with the second engagement portion 74 of the lever main body 121, and the second engagement piece 84 is separated from the support-member-side engagement portion 113 (inclined surface 114) of the handle support member 110.

From this state, when the torsion coil spring 81 is caused to slide downwardly with respect to the rotary shaft 122 by hand or the like, and the second engagement piece 84 is caused to move to a position below the second engagement portion 74 such that an engagement state between the second engagement piece 84 and the second engagement portion 74 is released, with the first engagement portion 73 and the first engagement piece 83 in the engagement state, the second engagement piece 84 automatically engages with the inclined surface 114 of the support-member-side engagement portion 113 due to the rotational bias force from the main body portion 82.

At this time, the rotational bias force from the torsion coil spring 81, which is applied to the handle support member 110 (the support-member-side engagement portion 113) and the inertia lever 120 (first engagement portion 73), is applied in a direction in which the inertia lever 120 is caused to rotate in a counterclockwise direction with respect to the handle support member 110 in a plan view. Therefore, when no external force is applied to the inertia lever 120 other than the rotational bias force from the torsion coil spring 81, the inertia lever 120 is held at the non-regulation position at which the stopper 71 comes into contact with the stopper surface 24*a* (not illustrated in FIGS. 15 to 20).

The handle device 100 having such a configuration performs the same operation as the handle device 20 of the first embodiment when the vehicle, in which the handle device 100 is mounted, collides with another vehicle and when the vehicle is in the normal state. In other words, it is possible to decrease a concern, with the inertia lever 120 and the torsion coil spring 81, that the locking device 13 will unexpectedly enter the switching mode from the latched state to the unlatched state when collision of the vehicle occurs. It is possible to intentionally cause the locking device 13 to perform a transition to the unlatched state by using the outside handle 21 in the normal state.

In the embodiment described above, similar to the first embodiment, while the relative rotation of the torsion coil spring 81 with respect to the inertia lever 120 is regulated, the inertia lever 120 and the torsion coil spring 81 are installed to the handle support member 110. Therefore, there is a decrease in concern that the second engagement piece 84 will hook on a portion of the handle support member 110 other than the support-member-side engagement portion 113, during the attachment work of the inertia lever 120 and the torsion coil spring 81 to the handle support member 110 and, as a result, it is not possible to install the inertia lever 120 and the torsion coil spring 81 to the handle support member 110.

Further, with the first engagement piece 83 and the second engagement piece 84 of the torsion coil spring 81 engaging with the first engagement portion 73 and the second engagement portion 74 of the inertia lever 120, respectively, (with the relative rotation of the torsion coil spring 81 with respect to the inertia lever 120 regulated), it is possible to install the inertia lever 120, which is integrated with the torsion coil spring 81, to the handle support member 110 by using the rotating center bar 130. In other words, it is possible to install the inertia lever 120 to the handle support member 110 without receiving an influence of the rotational bias force from the torsion coil spring 81.

Therefore, it is possible to install the inertia lever 120 to the handle support member 110 with a small force, compared to the first embodiment. Therefore, it is possible to easily install the inertia lever 120 and the torsion coil spring 81 to the handle support member 110 such that the torsion coil spring 81 is able to cause the inertia lever 120 to rotate and be biased.

As described above, the first and second embodiments disclosed here are described; however this disclosure is not limited to the embodiments described above.

For example, as long as a target member is a rotary member (member that is supported to be rotatable with respect to the handle support member) of a handle device for a door, it is possible to apply this disclosure to any member other than the inertia levers 65 and 120.

An example thereof includes the bellcrank 48 of the handle device 20 or 100. It is also possible to install the bellcrank 48 to the handle support member 23 or 110 in a state in which the bell crank and the torsion coil spring 57 are integrated with each other. Hence, when portions are provided in the bellcrank 48 so as to correspond to the first engagement portion 73 and the second engagement portion 74 with which the first engagement piece 59 and the second engagement piece 60 engage, and a portion is provided in the handle support member 23 or 110 so as to correspond to the support-member-side engagement portion 35 or 113, the same effects as in the first and second embodiment are achieved in a case where this disclosure is applied to the bellcrank 48 (and torsion coil spring 57).

The handle device 100 according to the second embodiment may include a detachable protective cover with respect to the handle support member 110.

It is also possible to realize the handle device as an inside handle device.

This disclosure may be applied to a handle device provided in a sliding-type vehicle door.

A vehicle handle device according to an aspect of this disclosure includes: a handle support member fixed to a vehicle door; a handle that is rotatably supported by the handle support member and causes, through rotating thereof, a locking device provided in the vehicle door to perform a transition from a latched state to an unlatched state; a rotary member that is installed to be rotatable around a predetermined rotary shaft with respect to the handle support member; and a torsion coil spring that has a main body portion which extends to have a spiral shape and is disposed on the periphery of the rotary shaft, and a first engagement piece and a second engagement piece which extend from both ends of the main body portion, respectively, and that generates a bias force that causes the rotary member to rotate around the rotary shaft when the first engagement piece and the second engagement piece engage with the rotary member and the handle support member, respectively, in a state in which the main body portion is elastically deformed. The rotary member includes a first engagement portion that engages with the first engagement piece, and a second engagement portion with or from which the second engagement piece is able to engage or to be separated in the state in which the main body portion is elastically deformed.

The rotary member has the first engagement portion that engages with the first engagement piece of the torsion coil spring, and the second engagement portion with and from which the second engagement piece is able to engage and to be separated in the state in which the main body portion of the torsion coil spring is elastically deformed.

Therefore, in a state in which the relative rotation of the torsion coil spring with respect to the rotary member is regulated, it is possible to install the rotary member and the torsion coil spring in the handle support member. Therefore, there is a decrease in concern that the second engagement piece will hook on a portion of the handle support member other than the support-member-side engagement portion during the attachment work of the inertia lever and the torsion coil spring to the handle support member and, as a result, it is not possible to install the inertia lever and the torsion coil spring to the handle support member.

Further, when the second engagement piece is separated from the second engagement portion and then engages with the handle support member, the torsion coil spring generates the bias force that causes the rotary member to rotate around the rotary shaft with respect to the handle support member.

Hence, it is possible to easily install the rotary member and the torsion coil spring to the handle support member such that the torsion coil spring is able to cause the rotary member to rotate and be biased with respect to the handle support member.

In the vehicle handle device according to the aspect, the handle support member may include a support-member-side engagement portion that engages with the second engagement piece and separates the second engagement piece from the second engagement portion when the rotary member is supported by the handle support member.

In this configuration, when the rotary member is supported by the handle support member, the second engagement piece of the torsion coil spring engages with the support-member-side engagement portion of the handle support member, and thereby the second engagement piece is automatically separated from the second engagement portion and automatically engages with the support-member-side engagement portion.

Hence, only the supporting of the rotary member by the handle support member enables the rotary member to be supported by the handle support member and, further, enables the second engagement piece of the torsion coil spring to engage with the support-member-side engagement portion.

Hence, it is possible to more easily install the rotary member and the torsion coil spring to the handle support member such that the torsion coil spring is able to cause the rotary member to rotate and be biased with respect to the handle support member.

In the vehicle handle device according to the aspect, the second engagement piece may be separated from the support-member-side engagement portion provided in the handle support member when the rotary member is supported by the handle support member in a state in which the first engagement piece engages with the first engagement portion and the second engagement piece engages with the second engagement portion, and the second engagement piece may engage with the support-member-side engagement portion when the main body portion of the torsion coil spring is caused to slide along the rotary shaft and thereby the second engagement piece is separated from the second engagement portion.

In this configuration, it is possible to install the rotary member to the handle support member with the second engagement piece engaging with the second engagement portion. In other words, it is possible to install the rotary member to the handle support member without receiving an influence of a rotational bias force from the torsion coil spring. Therefore, it is possible to install the rotary member to the handle support member with a small force.

In addition, when the main body portion of the torsion coil spring is caused to slide along the rotary shaft after the rotary member is installed to the handle support member, and the second engagement piece is separated from the second engagement portion and then engages with the support-member-side engagement portion, the torsion coil spring is able to cause the rotary member to rotate and be biased.

Hence, it is possible to more easily install the rotary member and the torsion coil spring to the handle support member such that the torsion coil spring is able to cause the rotary member to rotate and be biased with respect to the handle support member.

The vehicle handle device according to the aspect may further include: a linkage mechanism that is provided between the handle and the locking device, that transmits, to the locking device, a rotating force produced when the handle rotates from an initial position to an operational position, and that causes the locking device to perform the transition from the latched state to the unlatched state. The handle may be able to rotate between the initial position in which the locking device is in the latched state and the operational position in which the locking device is in the unlatched state. The rotary member may be an inertia lever that is able to rotate between a non-regulation position at which an operation of the linkage mechanism is not interrupted and a regulation position at which the operation of the linkage mechanism is interrupted, and that rotates from the non-regulation position to the regulation position when inertia acts thereon in a predetermined direction.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle handle device comprising:

a handle support member configured to be fixed to a vehicle door;

a handle that is rotatably supported by the handle support member and causes, through rotating thereof, a locking device provided in the vehicle door to perform a transition from a latched state to an unlatched state;

a rotary member that is installed to be rotatable around a predetermined rotary shaft with respect to the handle support member; and a torsion coil spring that has a main body portion which extends to have a spiral shape and is disposed on the periphery of the rotary shaft, and a first engagement piece and a second engagement piece which extend from both ends of the main body portion, respectively, and that generates a bias force that causes the rotary member to rotate around the rotary shaft when the first engagement piece and the second engagement piece engage with the rotary member and the handle support member, respectively, in a state in which the main body portion is elastically deformed, wherein the rotary member includes a first engagement portion that engages with the first engagement piece, and a second engagement portion with and from which the second engagement piece is able to engage and to be separated in the state in which the main body portion is elastically deformed, wherein the handle support member includes a support-member-side engagement portion that engages with the second engagement piece and separates the second engagement piece from the second engagement portion when the rotary member is supported by the handle support member.

2. The vehicle handle device according to claim 1, wherein the second engagement piece is separated from the support-member-side engagement portion provided in the handle support member when the rotary member is supported by the handle support member in a state in which the first engagement piece engages with the first engagement portion and the second engagement piece engages with the second engagement portion, and the second engagement piece engages with the support-member-side engagement portion when the main body portion of the torsion coil spring is caused to slide along the rotary shaft and thereby the second engagement piece is separated from the second engagement portion.

3. The vehicle handle device according to claim 1, further comprising:

a linkage mechanism that is provided between the handle and the locking device, that transmits, to the locking device, a rotating force produced when the handle rotates from an initial position to an operational position, and that causes the locking device to perform the transition from the latched state to the unlatched state, wherein the handle is able to rotate between the initial position in which the locking device is in the latched state and the operational position in which the locking device is in the unlatched state, and wherein the rotary member is an inertia lever that is able to rotate between a non-regulation position at which an operation of the linkage mechanism is not interrupted and a regulation position at which the operation of the linkage mechanism is interrupted, and that rotates from the non-regulation position to the regulation position when inertia acts thereon in a predetermined direction.

* * * * *